US005785036A

United States Patent [19]

Ninomiya et al.

[11] Patent Number: 5,785,036

[45] Date of Patent: Jul. 28, 1998

[54] ENGINE CONTROL SYSTEM

[75] Inventors: Hiroshi Ninomiya; Kouji Endo; Susumu Inoue, all of Hiroshima; Yuji Shitani, Hatsukaichi, all of Japan

[73] Assignee: Mazda Motor Corporation, Hiroshima, Japan

[21] Appl. No.: 718,839

[22] Filed: Sep. 24, 1996

[30] Foreign Application Priority Data

Sep. 26, 1995 [JP] Japan ..... 7-247570

[51] Int. Cl.[6] ..... F02D 41/00

[52] U.S. Cl. ..... 123/673

[58] Field of Search ..... 123/673, 675, 123/684, 698, 674, 692

[56] References Cited

U.S. PATENT DOCUMENTS

| | | | |
|---|---|---|---|
| 5,143,040 | 9/1992 | Okawa et al. | 123/684 |
| 5,423,307 | 6/1995 | Okawa et al. | 123/698 |
| 5,465,703 | 11/1995 | Abe | 123/674 |
| 5,501,206 | 3/1996 | Takebayashi | 123/674 |
| 5,515,834 | 5/1996 | Hoshino et al. | 123/674 |
| 5,520,160 | 5/1996 | Aota et al. | 123/675 |

FOREIGN PATENT DOCUMENTS 2-245441 10/1990 Japan .

*Primary Examiner*—Willis R. Wolfe
*Assistant Examiner*—Hieu T. Vo
*Attorney, Agent, or Firm*—Martin Fleit, PA

[57] ABSTRACT

A control system for a multiple cylinder engine includes a vapor fuel introduction system for introducing a vapor fuel vaporized in a fuel tank. A feedback device is used for setting an air fuel ratio feedback compensation value for each of the cylinders or each group of cylinders of the engine and for executing an air fuel ratio feedback control. A fuel supply device is used for supplying engine fuel for each cylinder so as to equalize the air fuel ratio feedback compensation values of each of the cylinders or each group of the cylinders regardless of a change of an operating condition of a vapor fuel introduction control. A desirable A/F feedback control can be accomplished regardless of the execution of the vapor fuel purge in the multiple cylinder engine.

32 Claims, 12 Drawing Sheets

ENGINE CONTROL SYSTEM

BACKGROUND OF THE INVENTION

1. Field of the Invention

The present invention relates to an engine control device and, in particular, an engine control system including a vapor fuel introduction system.

2. Description of Related Art

In an engine control system, a vapor fuel control in which vapor components vaporized in a fuel tank are introduced to an engine through a fuel introduction system has been known. In order to deal with a vapor fuel components generated in the fuel tank, currently, the vapor fuel is introduced into the engine together with normal injection fuel components for combustion without emitting in the air.

In this case, the vapor fuel generated in the fuel tank is introduced to a canister and trapped therein before being introduced to the engine. Then, when the engine is being operated in a predetermined condition, the trapped vapor fuel is purged by the air and introduced together with the normal fuel to the engine where the fuel is combusted and thereafter emitted in the air.

If the vapor fuel is emitted in the air without combustion, a problem of an emission of substance would occur. However, if the vapor is treated as aforementioned, such a problem can be eliminated.

As a conventional vapor fuel treatment system, for example, there is one which is disclosed in Japanese Patent Laid open publication No. 2-245441, which is laid open to the public in 1990.

In the system disclosed in Japanese Patent publication No. 2-245441, the amount of a vapor fuel introduced in the engine combustion chamber, namely, the amount of fuel purge, is stipulated in view of a feedback compensation coefficient for an air fuel ratio so that a fuel supply control is carried out by subtracting the fuel purge amount from the amount of a basic fuel injection.

It should be noted, however, that in the above Japanese Patent publication, the amount of the basic fuel injection is changed based on the fuel purge amount so that a control stability of the air fuel ratio feedback control would be deteriorated because the amount of the fuel supply is unduly influenced due to the change of the purge fuel amount.

In view of the above, it is proposed to subject the amount of the vapor fuel trapped by the canister to a learning control so as to speculate on the amount of the vapor fuel introduced to the engine at the time when the canister is opened so that the control stability can be obtained regardless of a fluctuation of the fuel amount trapped in the canister. The learning control is generally understood to determine a certain control value based on an experience of an actual operation of a system. A learned value obtained through the learning control is stored and used for the next occurrence of the control under a similar situation in which the learned value might be renewed again.

However, in a multiple cylinder engine, it is not necessarily true that the purge fuel amount introduced to each of the cylinders or each of banks of cylinders is constant; this is because lengths, configurations or sizes of passages to each of the cylinders or banks are not the same.

Therefore, even though the amount of the purge fuel could be precisely speculated, the amount of the purge fuel introduced to the engine is different among the cylinders, or among banks of cylinders in the V type engine. As a result, if the air fuel ratio feedback control is carried out based on an assumption that the purge fuel is uniformly introduced to each of the cylinders, the air fuel feedback control compensation value is unduly fluctuated so that the control stability of the air fuel ratio feedback could not be accomplished.

SUMMARY OF THE INVENTION

It is therefore an object of the present invention to provide a stable engine control in which a desirable air fuel ratio feedback control can be accomplished regardless of the dispersion of the fuel purge amount between the cylinders.

The above and other objects of the present invention can be accomplished by a multiple cylinder engine comprising a vapor fuel introduction system for introducing a vapor fuel vaporized in a fuel tank, feedback means for setting an air fuel ratio feedback compensation value for each cylinder or each group of cylinders of the engine and for executing an air fuel ratio feedback control, and fuel supply means for supplying fuel for each cylinder so as to equalize the air fuel ratio feedback compensation values of each of the cylinders or each of the groups of the cylinders regardless of a change of an operating condition of a vapor fuel introduction control.

In a preferred embodiment, the fuel supply means is provided with distribution ratio calculation means for calculating a distribution ratio of the vapor fuel to the cylinders or groups of cylinders. The fuel supply means supplies the fuel based on the distribution ratio to the cylinders or the groups of the cylinders.

In another preferred embodiment, the fuel supply means supplies the fuel to the engine so as to equalize the feedback compensation values for the cylinders or the groups of the cylinders where a difference of the feedback compensation values exceeds a predetermined value between the cylinders or the groups of the cylinders.

Further, in another preferred embodiment, there is provided vapor fuel learning means for executing a learning control with regard to an amount of vapor fuel introduced to the engine based on the change of the feedback compensation value so that the distribution ratio is calculated based on the amount of vapor fuel obtained through the learning control. The learned amount of the vapor fuel is stored in the system and used for a later control. Typically the learned amount of the vapor fuel would be an amount of the vapor fuel which is trapped in a canister.

In another preferred embodiment of the present invention, the fuel supply means supplies the fuel to the engine so as to equalize feedback compensation values of each of the cylinders or the groups of the cylinders.

In another aspect of the present invention, in a V-type multiple cylinder engine, there are provided oxygen sensors for each of the banks of the engine. The distribution ratio for each of the banks are determined in a manner so that the feedback compensation values of each of the banks are equalized.

In a preferred embodiment, the fuel supply means supplies the fuel to the engine so as to equalize the feedback compensation values of the cylinders of both banks where a difference of the feed back compensation values thereof exceeds a predetermined value.

In the present invention, a control of the amount of the fuel supply through a normal fuel supply system is controlled by controlling a fuel injection pulse width.

An introduction or purge of vapor fuel to the engine is carried out where it is judged proper through a monitor of the engine operating condition in terms of an emission control of the exhaust gas.

Further objects, features and advantages of the present invention will become apparent from the Detailed Description of Preferred Embodiments which follows when read in light of the accompanying Figures.

DETAILED DESCRIPTION OF THE PREFERRED EMBODIMENTS

Hereinafter, the present invention is described in detail taking reference with the attached drawings.

Figure 1:
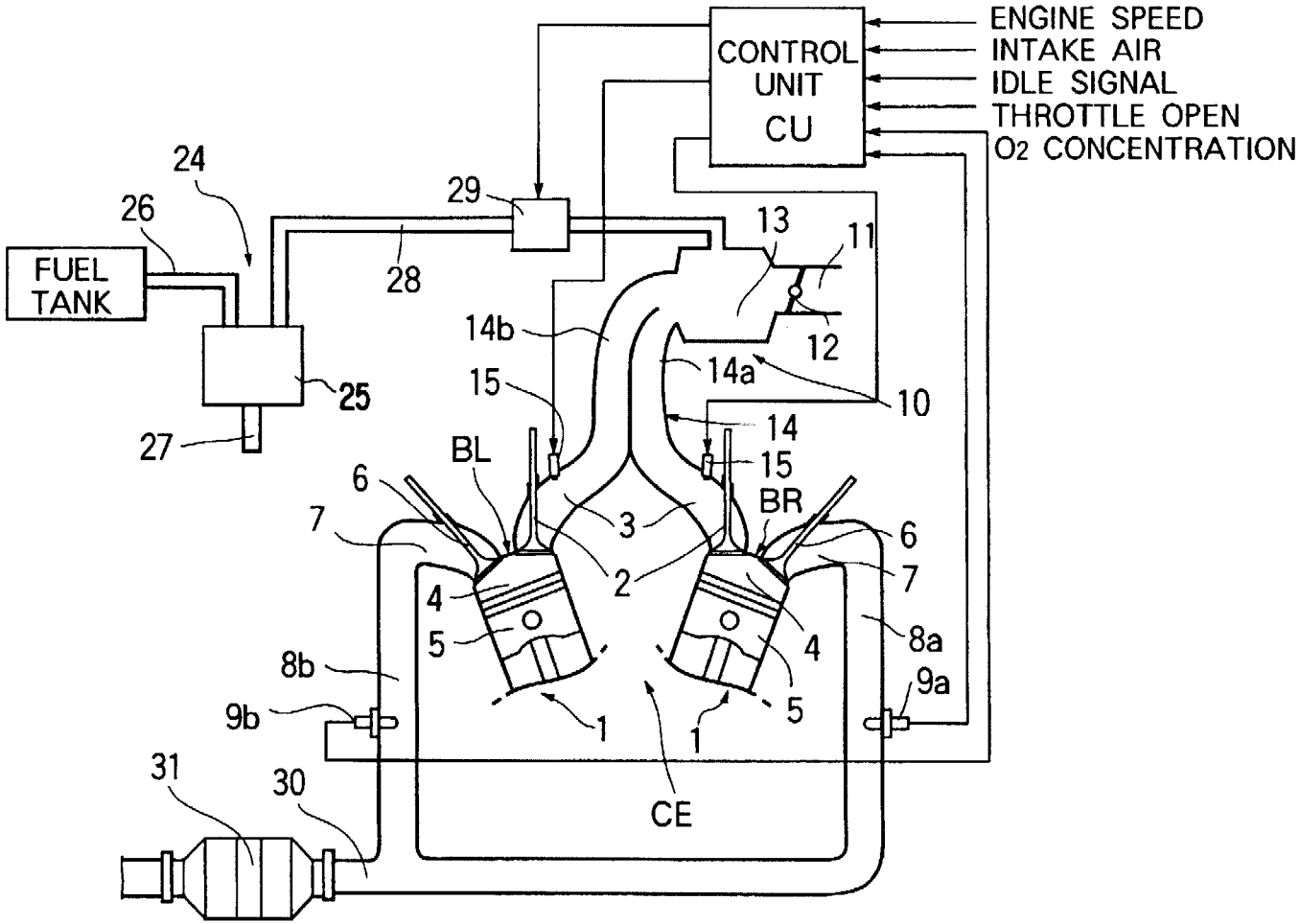
FIG. 1 is a schematic block diagram of a multiple cylinder engine to which the present invention can be applied.

FIG. 1 is a schematic view of a block diagram of an engine provided with a vapor fuel speculation device and control device according to the present invention. As shown in FIG. 1, the engine is a V-type engine including 6 cylinders divided into right and left banks BR, BL. One of the cylinders 1 which belongs to each of the right and left banks BR, BL is shown. In each of the cylinders 1, an engine fuel gas mixture is introduced from an intake port 3 to a combustion chamber 4 when an intake valve 2 is opened. The fuel gas mixture is compressed by a piston 5 and thereafter ignited by an ignition plug (not shown) and combusted and the resultant gas or exhaust gas is exhausted to an exhaust passage through an exhaust port 7 when an exhaust valve 6 is opened. Exhaust gas passages 8*a*, 8*b* from the right and left banks BR, BL are merged to form the exhaust gas passage 30. Linear oxygen sensors 9*a*, 9*b* are disposed for sensing an oxygen concentration in the passages 8*a*, 8*b* in a manner that the sensors 9*a*, 9*b* appear in the passages 8*a*, 8*b*. The exhaust passages 8*a*, 8*b* are merged to the single exhaust passage 30 in which a catalytic converter 31 is disposed to improve an emission performance.

Oxygen concentration (O2 concentration) output sensed by the linear O2 sensors is introduced to the control unit CU in which an air fuel ratio of the fuel gas mixture is calculated based on the output related to O2 concentration. The 02 concentration detected by linear O2 sensors 9*a*, 9*b* corresponds directly to the air fuel ratio calculated by the O2 concentration. Thus, the above air fuel ratio is referred to as "air fuel ratio detected by the linear O2 sensor 9" or "actual air fuel ratio". In this case, in place of the linear O2 sensors 9*a*, 9*b*, a λO2 sensor may be employed. The linear O2 sensor can detect O2 concentration and thus the air fuel ratio. It should however be noted that the λO2 sensor can detect only whether or not an air excess rate is greater than one.

An intake system 10 is provided for supplying air for combusting the fuel to the cylinder 1 (combustion chamber 4) of the engine CE. The intake system 10 is provided with a common intake passage 11 of which an upstream end is opened to the air. In the common intake passage is provided a throttle valve 12 adapted to open and close in connection with an acceleration pedal (not shown). A down stream end of the common intake passage 11 is communicated with a surge tank 13 for stabilizing an intake gas flow. Further, a down stream side of the surge tank 13 is divided into branch intake passages 14*a*, 14*b*, thereafter, into independent passages 14 (only one of which is shown) for independently introducing the fuel gas mixture to the respective cylinders 1. Downstream ends of the respective independent intake passages 14 are connected to intake ports 3 of the respective cylinders 1.

In the independent intake passage 14 in the vicinity of the intake port 3, an engine fuel injection valve 15 which is adapted to inject the fuel into the intake port 3 or combustion chamber 4 in a manner such that an injection nozzle of the valve 15 is projected in the passage 14 and oriented to the downstream end of the intake passage 14. In this case, an amount of fuel injection (fuel injection pulse width) and an injection timing of the injection valve 15 are controlled by the control unit CU.

The engine CE is provided with a vapor fuel recovery device 24 including a vapor fuel collection device for collecting or trapping a vapor fuel (gasoline vapor) and vapor fuel purge device for purging the vapor fuel collected in the collecting device into the intake system 10 by means of purge air at an appropriate interval. Hereinafter, the vapor fuel recovery device 24 is explained.

The vapor fuel recovery device 24 is provided with a canister 25 stuffed with an adsorbent, such as activated carbon, which is able to collect or adsorb the vapor fuel. To the canister 25 is connected a relief passage 26 communicated with an upper space of the fuel tank for relieving an air therein to the canister 25, an open passage 27 open in the outside air, and a purge passage 28. In this case, the open passage 27 may be connected with the common passage 11 at an upstream side of the throttle valve 12. Further, the canister may be stuffed with a material capable of collecting the vapor fuel making use of a phenomenon other than the adsorption, such as absorption, reaction and the like provided that the collected vapor fuel can be purged by means of air.

In the purge passage 28 is disposed a purge control valve 29 of a duty solenoid type adapted to be opened and closed through a duty control by the control unit CU. The control valve 29 is controlled to be opened and closed in accordance with a drive duty ratio applied by the control unit CU. For example, the valve 29 is entirely closed when the duty ratio is zero and fully opened when the duty ratio is 100%. Thus, the greater the duty ratio is, the greater the valve is opened.

With regard to the vapor fuel recovery device 24, when the purge valve 29 is entirely closed (duty ratio is zero), the air in the fuel tank is relieved to the canister 25 through the passage 26 and then emitted in the air through the open passage 27. It should be noted, however, that the vapor fuel included the air in the tank is collected by the adsorbent when the air passes through the adsorbent layer and thus the vapor fuel is not emitted in the air.

On the other hand, when the purge control valve 29 is opened, the ambient air is absorbed into the canister due to a negative pressure of the intake system 10 through the open passage 27 and passes through the adsorbent layer and thereafter is purged through the purge passage 28 to the intake system 10, such as the surge tank 13, branch intake passages 14*a*, 14*b*, independent passage 14 and eventually to the combustion chamber 4. It should be noted that a distribution of the vapor fuel introduced to the respective cylinders through the single purge passage 28 is not the same since length, size, configuration of the path and flow resistance of paths to the cylinders are different.

The flow rate of the purge air (hereinafter referred to as the purge air amount) varies depending on the opening degree of the purge valve 29 (drive duty ratio). In this case, the vapor fuel trapped by the canister 25 is partly separated from the adsorbent and purged together with the purge air to the combustion chamber 4.

Hereinafter, the flow rate of the vapor fuel purged into the intake system 10 and thus into the combustion chamber 4 is referred to as vapor fuel purge amount.

In another aspect, a volume of a transfer path of the air or vapor fuel from the canister 25 to the combustion chamber 4 is fairly big and thus a certain transfer time lag is produced due to the volume and configuration (transfer characteristics) before the vapor fuel discharged from the canister 25 to the purge passage 28 actually reaches the combustion chamber 4. Therefore, the flow rate of the vapor fuel discharged from the canister 25 to the purge passage 28 (hereinafter referred to as a vapor fuel discharge amount) at a certain time is usually not identical with the flow rate of the vapor fuel actually introduced to the combustion chamber 4 (hereinafter referred to as a vapor fuel introduction amount) with exception of specific conditions such as a constant operating condition. In view of this, the following explanation of the vapor fuel purge amount is made with regard to the discharge amount and vapor fuel introduction amount separately.

Meanwhile, where the volume of transfer path of the purge air or vapor fuel is very small, it is not necessary to discriminate the vapor fuel discharge amount and the vapor fuel introduction amount. Namely, it is possible to use the vapor fuel purge amount generally.

The control unit CU is a total control device including a microcomputer for controlling the engine CE (including the vapor fuel recovery device 24). The control unit CU estimates the amount of the vapor fuel collected in the canister 25 (trap amount), computes the vapor fuel discharge amount, computes the vapor fuel introduction amount and the like based on the air fuel ratio A/F (actual A/F) detected by the linear O2 sensors 9*a*, 9*b* (λO2 sensor), throttle opening detected by the throttle opening sensor, the amount of the intake air detected by an air flow meter, engine speed detected by an engine speed sensor, idling signal from an idle switch and the like.

Since the general control of the engine is well known, a detailed explanation will be omitted. Hereinafter, an air fuel ratio (A/F) control (namely fuel injection control), canister purge control, estimate of the trap amount, computation of the amount of the vapor fuel discharge amount and computation of the vapor fuel introduction amount will be explained.

Hereinafter, a basic function of the control unit CU will be explained taking reference with FIG. 2.

Figure 2:
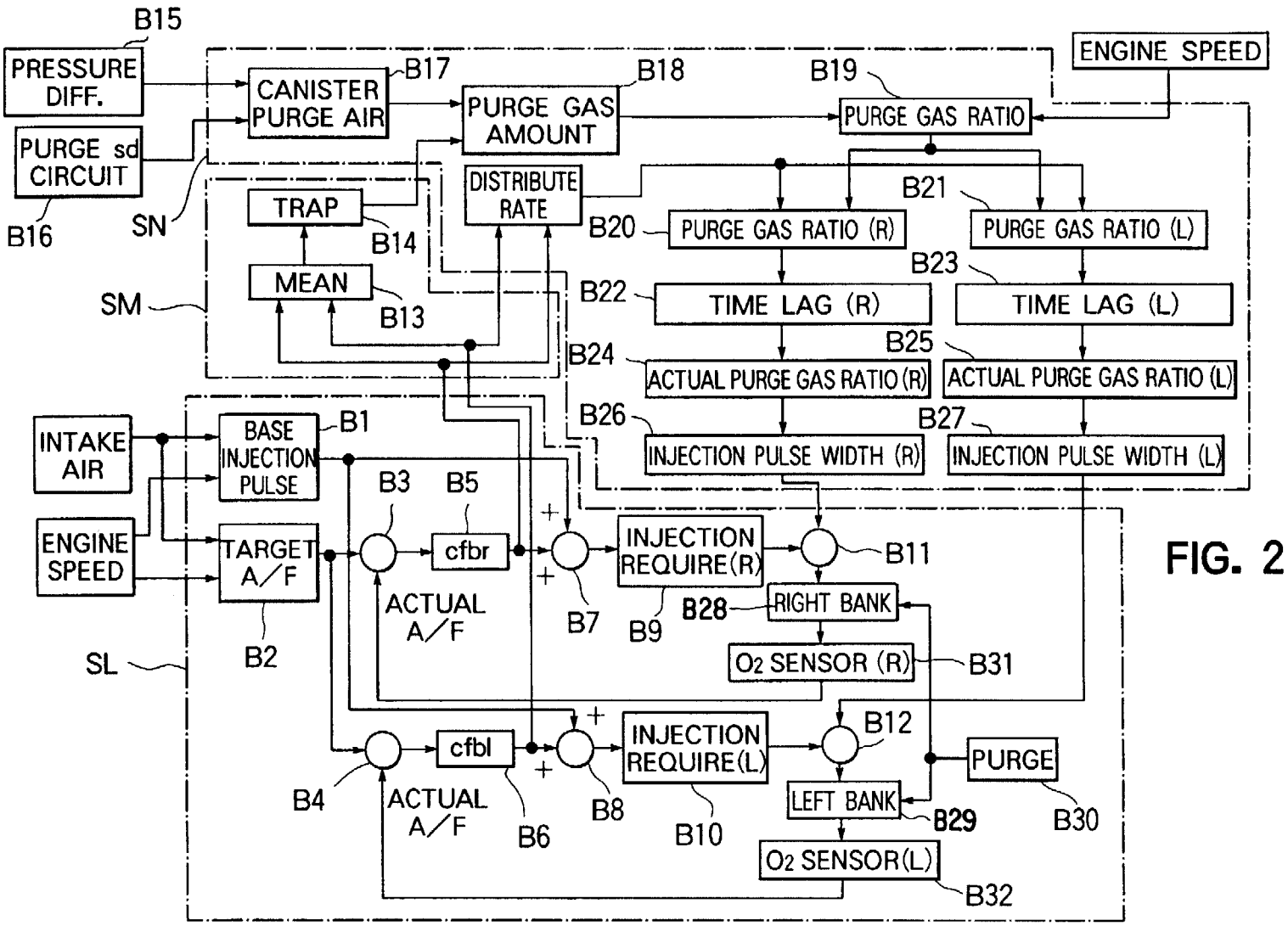
FIG. 2 is a block diagram showing function of a control unit CU for executing an air fuel ratio feedback control and vapor fuel introduction control.

As shown in FIG. 2, the control unit CU is functionally provided with an engine control block SL for executing the A/F control and canister purge control, trap amount estimate block SM, vapor fuel purge computation block SN for computing the vapor fuel discharging amount and introduction amount to each banks BR, BL based on the trap amount.

The engine control block SN carries out an A/F feedback or open controls of the fuel injection pulse width of the fuel injection valve 15 or fuel injection amount in accordance with the engine operating condition (air fuel ratio (A/F) control), and purges the canister in a predetermined operating condition (canister purge control).

In the A/F control, where the engine operating condition is in a predetermined feedback control area (for example, other than heavy load area, high speed area), the feedback control is carried out based on a deviation of the actual A/F to target A/F(herein after referred to as A/F deviation). If not, the open A/F is carried out. The feed back control is made as follows.

The basic fuel injection amount of the fuel injection valve 15 is calculated based on the intake air amount of the engine speed (B2). Concurrently, the target A/F is determined base thereon (B2).

Next, the control unit CU calculates the A/F deviation (For example target A/F–actual A/F) (B3, B4) and calculates the feedback compensation values cfbr, cfbl for groups of cylinders belonging to the respective banks of the engine CE. The compensation values cfbr and cfbl take a neutral value zero when the A/F is not compensated. In case of the value cfbr, cfbl>0, the A/F(thus, fuel injection amount) is compensated toward a rich side or increasing fuel injection. On the other hand, in case of the value cfbr, cfbl<0, the A/F is compensated toward a lean side or decreasing the fuel injection.

The control unit compensates the basic pulse width so as to reduce the A/F deviation based on the basic pulse width and the feedback compensation values cfbr, cfbl of the respective banks BR, BL by for example multiplying the basic pulse width into the feedback compensation values cfbr, cfbl to thereby obtain a required pulse width or required fuel injection for each of the cylinders of the banks BR, BL (B9, B10). For example, where the actual A/F is greater than the target A/F, the values cfbr, cfbl take values>0 so that the fuel injection amount is increased to make the A/F rich to reduce the A/F deviation. Conversely, where the actual A/F is less than the target A/F, the values cfbr, cfbl take values <0 so that the fuel injection amount is reduced to make the A/F lean to reduce the A/F deviation. Thus, the feedback control is carried out to eliminate the A/F deviation based on the A/F deviation with regard to the A/F (fuel injection amount).

On the other hand, where the open loop control is carried out, the feedback compensation values cfbr, cfbl are fixed to a value zero. In this case, the basic fuel injection pulse width is used to obtain the required pulse width without being compensated in accordance with the A/F deviation. Therefore, the fuel injection control is an open control not utilizing the O2 sensors 9a, 9b.

Further, the control unit CU calculates an actual fuel injection pulse of the fuel injection valve 15 thus, the actual fuel injection amount by subtracting an injection pulse width corresponding to the vapor fuel introduction amount from the required pulse widths, or the required fuel injection amount (B11, B12). with this actual injection pulse width and with a predetermined timing, the fuel is injected from the injection valve 15. Thus, the actual A/F is controlled to be converged to the target A/F.

Where a certain condition is met, for example, where a temperature of a cooling water reaches a predetermined value (80 degrees centigrade), the canister purge control is carried out in a well known manner in accordance with the engine CE operating condition. Namely, a duty ratio in accordance with the engine operating condition is applied to a purge valve 29 for the canister purge.

The trap amount estimate block SM calculates a mean feedback compensation value cfbave of the value cfbr, cfbl obtained in the block B5, B6 for a predetermined time period (B13). The block SM estimates the trap amount indirectly based on the mean feedback compensation value (B14). Namely, using the value cfbave, it is judged whether or not the estimated trap amount is greater than a true trap amount.

The control unit CU calculates the vapor fuel introduction amount based on the estimated trap amount by means of a predetermined formula and determines the actual fuel injection amount by subtracting the vapor fuel introduction amount from the required fuel injection amount (B11, B12). If the estimated trap amount is enough to be close to the true trap amount, the vapor fuel introduction amount can be calculated precisely. Therefore, the introduction of the vapor fuel to the combustion chamber 4 will not affect badly the A/F feedback control and thus the compensation values cfbr, cfbl. In this case, if there is no other noise, the compensation values cfbr, cfbl varies around the neutral value (0). Thus, the mean value cfbave is approximately zero. In other words, if the means feedback compensation value is nearly zero, it would be found that the estimated trap amount accords to the true trap amount.

However, if the estimated trap amount is greater than the true value, the calculated vapor fuel introduction amount becomes the true value. As a result, the actual fuel injection amount is smaller than an appropriate value so that the actual amount of the fuel introduced to the combustion chamber 4 is smaller than the required fuel injection amount and thus the actual A/F would be lean. In this case, in order to correct this lean tendency of the fuel injection, the values cfbr, cfbl are changed toward the rich side and become greater than the value 0. Consequently, the mean value cfbave becomes greater than the value zero. In other words, if the mean value cfbave is greater than zero, this means that the estimated trap amount is greater than the true value.

As aforementioned, the values cfbr, cfbl vary. Therefore, a value of the estimated trap amount greater than the true value does not necessarily provide the values cfbr, cfbl>0. Thus, the values cfbr, cfbl>0 does-not necessarily provide the greater value of the estimated trap amount than the true value. Accordingly, where the trap amount is estimated based on the values cfbr, cfbl, an accuracy of the estimate would be low. In view of this, in the present invention, the trap amount is estimated based on the mean feedback compensation value.

Conversely, where the estimated trap amount is smaller than the true value, the calculated vapor fuel induction amount becomes smaller than the true value, the actual fuel injection amount becomes greater than the appropriate value. As a result, the actual fuel amount introduced to the combustion chamber 4 becomes greater than the required fuel injection amount and thus, the A/F becomes rich. In order to correct this rich tendency, the feedback compensation values cfbr, cfbl are changed toward the lean side and reduced below zero. In other words, if the mean feedback compensation value cfbave is greater than zero, the estimated trap amount would be smaller than the true trap value.

At first, an appropriate initial value is provided as an estimated trap amount. If the mean value cfbave is greater than zero, the estimated trap amount is reduced by a compensation value $\sigma$. If the mean value cfbave is smaller than zero, the estimated trap amount is increased by a compensation value $\sigma$. If the above process is repeated, the estimated trap amount would be converged to the true trap amount. Thus, the trap amount can be estimated based on the mean feedback compensation value.

In this case, it is preferable that whether or not the estimated trap amount is substantially the same as the true trap amount, that is, whether or not the estimate process has been completed is judged based on whether or not the absolute value of the mean feedback compensation value is smaller than a critical value $\epsilon$. This is because if the mean feedback compensation value is small enough, it is considered that the estimated trap amount is substantially the same as the true value.

In the above process for estimating the trap amount, it is assumed that there is a relationship as aforementioned between the trap amount or vapor fuel purge amount and the feedback compensation values cfbr, cfbl or the mean value cfbave. Therefore, if there is no or weak relationship therebetween, it is difficult to estimate the trap amount precisely. In view of this, under the above circumstances, it is preferable to suspend the estimate of the trap amount. Where the charging efficiency or intake gas pressure is very high or low beyond a predetermined level, the relationship as aforementioned between the trap amount or vapor fuel purge amount and the feedback compensation values cfbr, cfbl or the mean value cfbave is considered weak. Where the canister purge is suspended, underway, or where the A/F feedback control is suspended (under the open control), it is considered that the above relationship does not exist.

The estimate of the trap amount can be suspended or prohibited where one or more conditions as aforementioned are met. In the above trap amount estimate process, the following relationship is assumed. If the vapor fuel introduction amount is precisely obtained, in other words, if the introduction of the vapor fuel due to the canister purge does not affect badly the values cfbr, cfbl, the values cfbr, cfbl vary around the neutral value zero and thus the mean value cfbave is converged to zero. Meanwhile, it is common that the fuel injection property is compensated automatically based on a learning control with regard to the A/F. In this case, it is preferable that where the trap amount is estimated in an engine with the A/F learning control system, the trap amount is estimated after the completion of the A/F learning control. This is because if the A/F learning control is completed, the mean feedback compensation value cfbave is reliably converged to the neutral value zero.

It is preferable that a judgement that the trap amount estimate has completed is reset if the above process for estimating the trap amount had been consecutively suspended beyond a predetermined period. This is because the estimated trap amount may be unduly deviated from the true value.

Where the compensation value σ is big, the accuracy of the estimated trap amount is lowered although a time period for obtaining the estimated value can be shortened. Conversely, where the compensation value σ is small, the accuracy of the estimated trap amount is improved, although a time period for obtaining the estimated value gets long. Accordingly, it is preferable to provide the compensation value σ with an appropriate value to reconcile the time for convergence and the accuracy of the estimated value. In this case, the compensation value σ is not necessarily constant and can be changed during the trap amount estimate process. For example, the value σ can be provided in accordance with a running condition of the trap amount estimate process or the mean feedback compensation value. In one embodiment, a larger value is provided for the value σ at the beginning of the estimate process to facilitate the convergence and thereafter a smaller value therefor is provided to improve the accuracy of the estimate. If the value σ is increased as the mean feedback compensation value is increased, the convergence is facilitated where the deviation between the estimated trap amount and the true value is large and the accuracy can be improved where the deviation therebetween is small.

In the present embodiment, the values cfbr, cfbl are obtained for each of the right and left banks BR, BL and a distribution ratio of the vapor fuel to the respective banks BR, BL are calculated based on the values cfbr, cfbl. This distribution ratio is detected through a similar manner to that of the mean feedback compensation value. The ratio of the values cfbr:cfbl is calculated and if the ratio is greater than 1, it is judged that the distribution for the left bank is greater than that for the right bank. In this case, a predetermined compensation value c is provided for the left bank BL. With the above manner, the compensation value c is provided to either the right bank or the left bank and renews the distribution ratio by means of the learning control so that the ratio between the values cfbr:cfbl is converged to 1.

In this case, the learning control of the distribution ratio is executed when a stable A/F feedback control is being done.

The vapor purge amount computation block SN computes the vapor fuel discharge amount based on the estimated trap amount obtained in the step B14 of the block SM, computes the vapor fuel introduction amount based on the discharge amount, computes a purge compensation pulse width of the fuel injection valve 15 corresponding to the vapor fuel introduction amount and output the purge compensation pulse width to the engine control block SL. In short, an influence of the canister purge to the A/F control is compensated without a substantial time lag through the above, so called, feedforward control (prospective control).

In detail, a pressure difference of a front and rear of a purge valve 29 disposed in the purge passage 28 is detected (B15). An opening of the purge valve 29 is calculated based on a drive duty ratio applied to the purge valve 29. Then, the purge air amount (canister purge air amount) is calculated based on the pressure difference and the opening of the purge valve (B17).

In this case, the pressure difference due to the purge valve 29 is calculated based on the intake gas charging efficiency. The intake pressure can be obtained based on the charging efficiency. The downstream pressure of the purge valve 29 is substantially the same as the intake pressure. The upstream pressure of the valve 29 is deemed as a constant value (ambient pressure). Therefore, the pressure difference between the up and down stream of the purge valve 29 is substantially the same as the difference between the ambient pressure and the intake pressure. Thus, the pressure difference due to the purge valve 29 can be obtained by processing the charging efficiency. With this system, there is no need to provide an intake pressure sensor to simplify the intake system 10.

The downstream pressure of the purge valve 29 can be detected by an intake pressure sensor. A pressure difference sensor for detecting the pressure difference due to the purge valve directly can be provided.

The purge air amount can be calculated by means of a well known manner based on the pressure difference due to the purge valve 29.

Generally, a pressure loss ΔP of a device disposed in a closed path of a fluid and a flow rate u of the fluid has a relationship (for example ΔP=k*u2). Thus, the flow rate can be calculated based on the pressure loss of the device. By multiplying a cross section area into the flow rate, a mass flow rate of the fluid can be obtained. In view of this, the cross sectional area of the flow of the purge valve 29 can be readily obtained based on the opening thereof. Thus, the purge air amount (mass flow rate) can be obtained based on the pressure difference due to the purge valve 29 and the opening thereof (drive duty ratio).

Alternatively, the purge air amount can be detected by a flow rate sensor directly.

The vapor fuel discharge amount (purge gas mass flow rate or vapor fuel mass flow rate) is calculated based on the purge air amount obtained in B17 and the estimated trap amount (B18). Next, a purge gas ratio is calculated based on the engine speed and the vapor fuel discharge amount (B19). In this case, the purge gas ratio (R), (L) is defined as a ratio of the vapor fuel discharged from the canister 25 to the purge path 28 to the required total fuel (the required fuel injection), or the contribution rate of the vapor fuel to the combustion in the engine. Thereafter, the control unit calculates the purge ratio R, L for the respective banks BR, BL on account of the distribution ratio (B21, B22). The control unit CU determines the time lag due to a path of the purge air or vapor fuel from the canister 25 to the combustion chamber 4 (vapor fuel path) (B22, B23), then calculates an actual purge gas ratio based on the purge gas ratio and the time lag (B24, B25). The actual purge gas ratio is defined as a ratio of the vapor fuel introduction amount to the total required fuel injection amount. Thus, the fuel amount to be injected from the injection valve 15 is provided as a value obtained by multiplying the required fuel injection amount into a value (1−actual purge gas ratio). Then, the control unit calculates the purge compensation pulse width of the injection valve 15 corresponding to the actual purge gas ratio (vapor fuel introduction amount) (B26, B27), then subtract the pulse width from the required fuel injection amount R, L in the engine control block SL to determine a final fuel injection pulse width of each of the cylinders of the bank BR, BL and produces a predetermined pulse width for each of the cylinders of the respective banks BR, BL (B28, B29).

The control unit CU purges the vapor fuel produced in the fuel tank by introducing a signal to a purge injection valve under a predetermined operating condition. The purged vapor fuel is introduced to the combustion chamber in addition to the normal fuel.

The O2 sensors *9a*, *9b* are provided for the respective banks BR, BL to get a signal which can be used as a parameter for the A/F feedback control (B31, B32). An actual A/F is calculated based on the signal of the sensors 9a, 9b and the actual A/F is compared with a target A/F.

Figure 3:
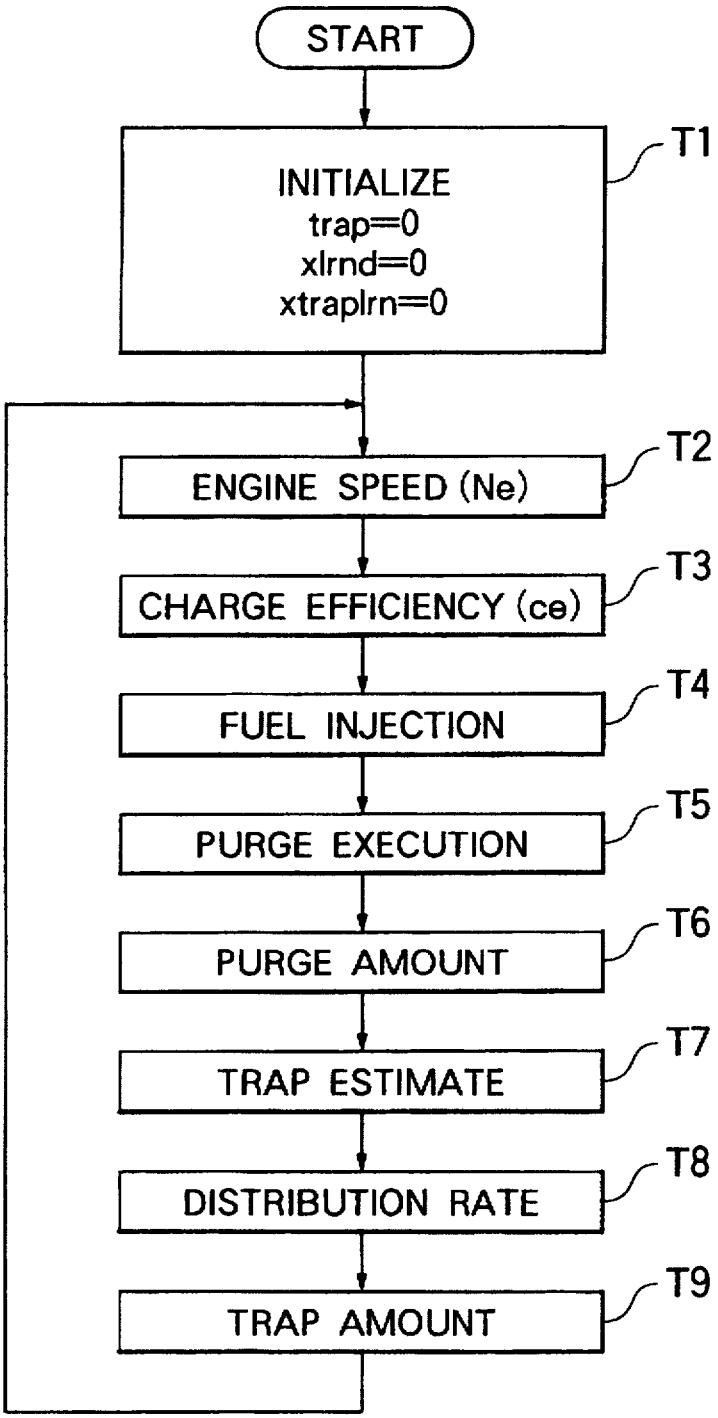
FIG. 3 is a flow chart of a main routine where an engine fuel control according to the present invention is executed by the control unit CU.
Figure 10:
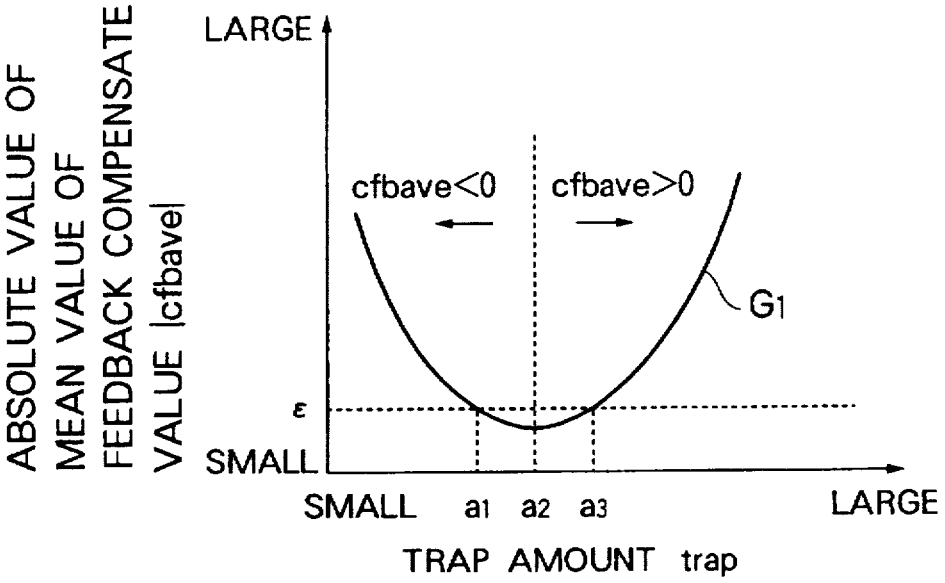
FIG. 10 is a graphical representation of characteristics for showing a relationship between a mean value of a feedback compensation value and the trap amount.

Referring to FIG. 3 though FIG. 10, specifically taking reference with FIG. 3 showing main routine, an entire control or computation according to the present invention will be explained.

In step T1, the system is initialized. Namely, an initial value zero is provided for the estimated trap amount trap, A/F learning control completion flag xlrnd, trap amount estimate completion flag xtraplrn. Where A/F learning control is completed, the flag xlrnd takes a value 1. Where the trap amount estimate process is completed, the flag xtraplrn takes a value 1.

In step T2, the engine speed ne is calculated and in step T3, the charging efficiency ce is calculated. In this case, the charging efficiency ce is calculated in a well known manner based on the intake air amount, engine speed ne, a temperature of the intake air and the like.

Figure 4:
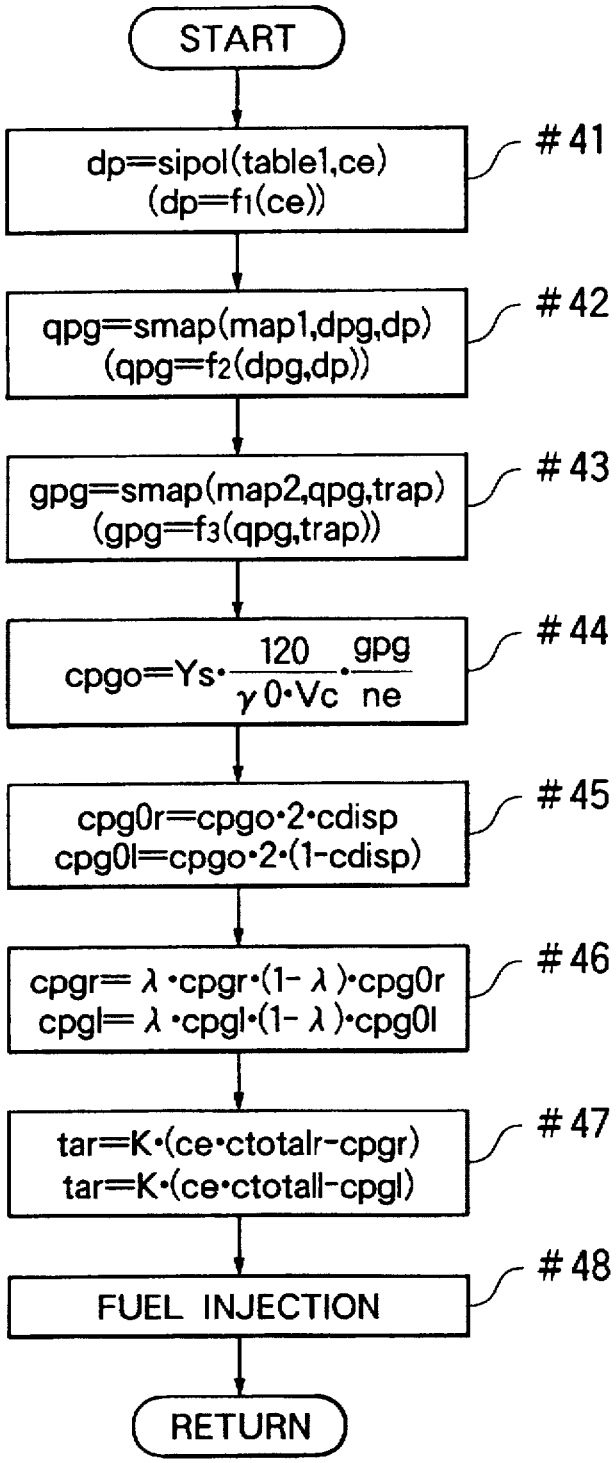
FIG. 4 is a flow chart of a subroutine for executing the fuel injection referred to in the main routine of FIG. 3.
Figure 5:
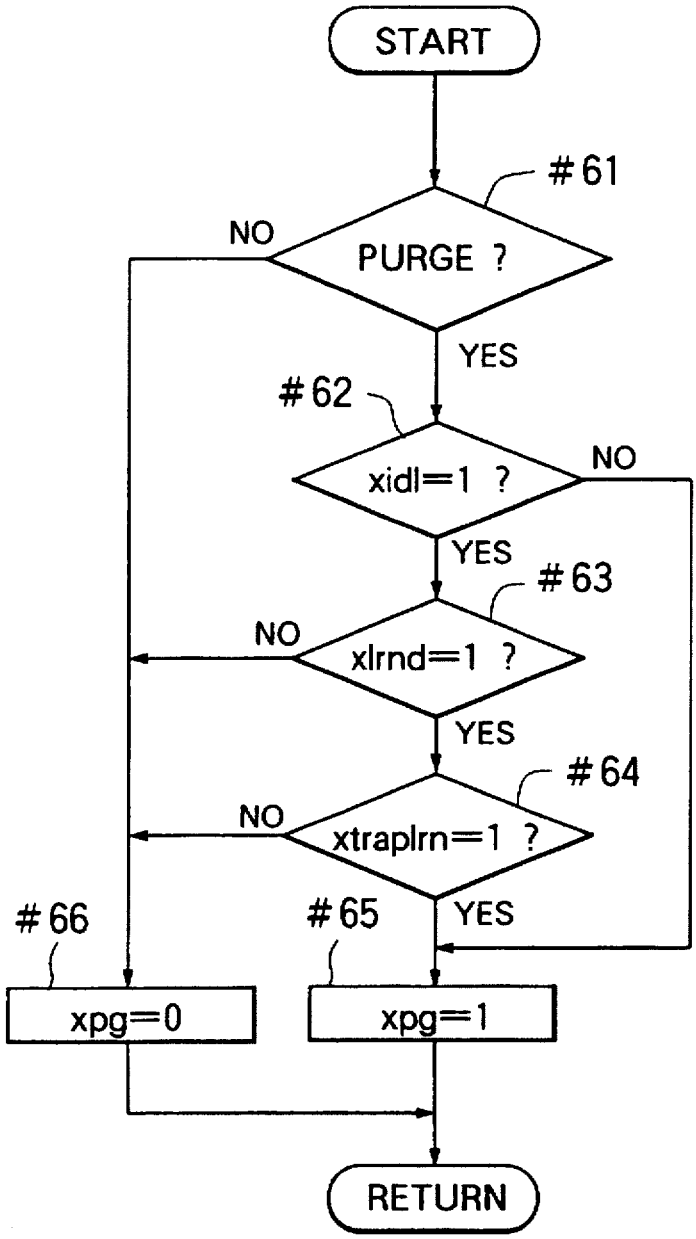
FIG. 5 is a flow chart of a subroutine for judging whether or not a purge control referred to in the main routine of FIG. 3 can be carried out.
Figure 6:
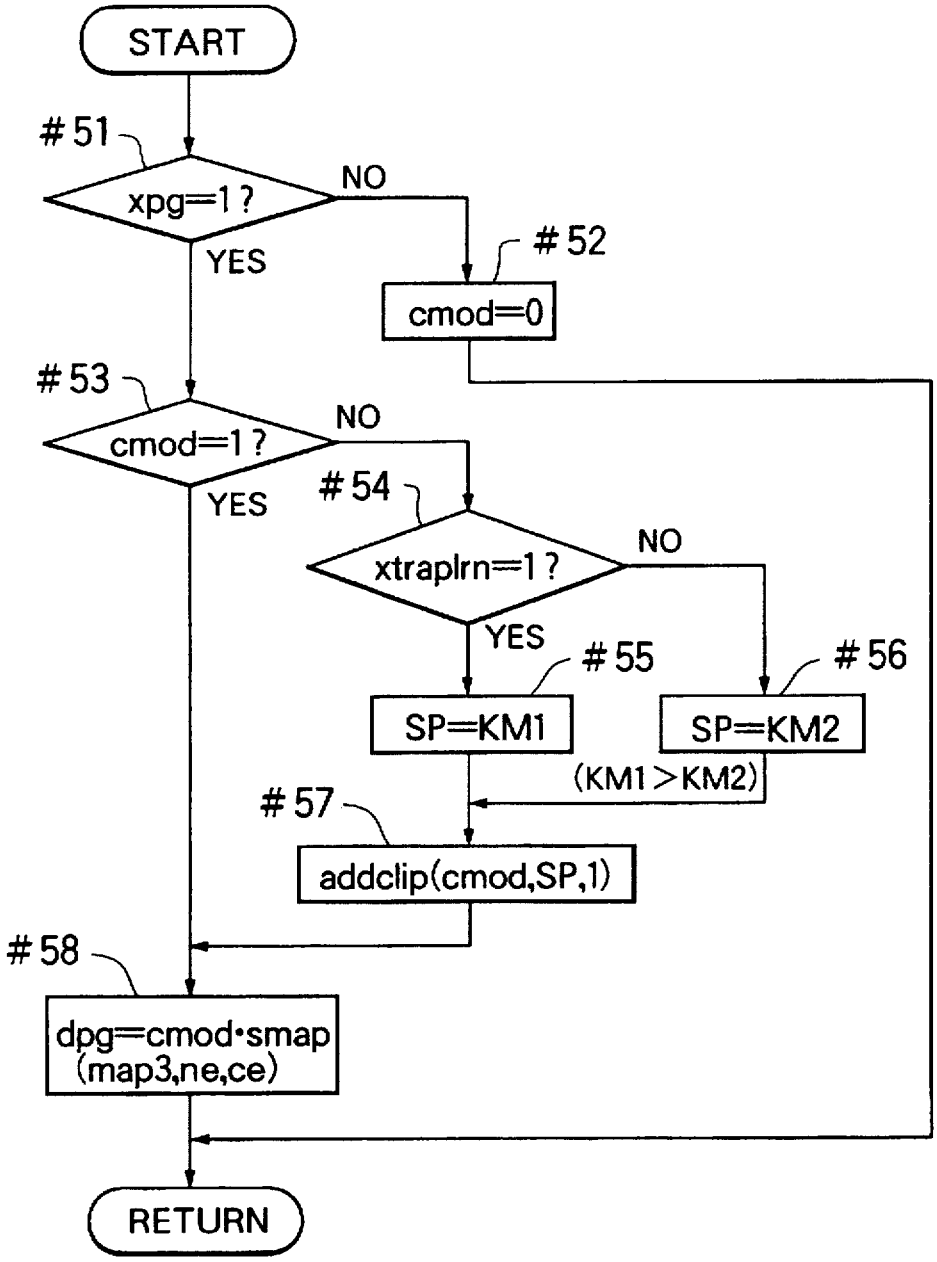
FIG. 6 is a flow chart of a subroutine for determining a purge amount in the main routine of FIG. 3.

Thereafter, the steps T4–T9 are executed in this order. In this case, the steps T4–T5 are executed by utilizing subroutines explained hereinafter. In step T4, the fuel injection amount is calculated utilizing a subroutine program as shown in FIG. 4. In step T5, a judgement for an execution of the vapor fuel purge is made using a subroutine program as shown in FIG. 5. In step T6, the vapor purge amount is calculated using a subroutine program as shown in FIG. 6. In step T7, the estimate of the vapor fuel trap amount is processed using a subroutine shown in FIG. 7. In step T8, the distribution ratio is calculated using a subroutine program shown in FIG. 8. In step T9, the vapor fuel trap amount is calculated using a subroutine program shown in FIG. 9. Then, the process is returned to the step T2.

Hereinafter, the procedures in each of the subroutines are explained specifically.

Figure 8:
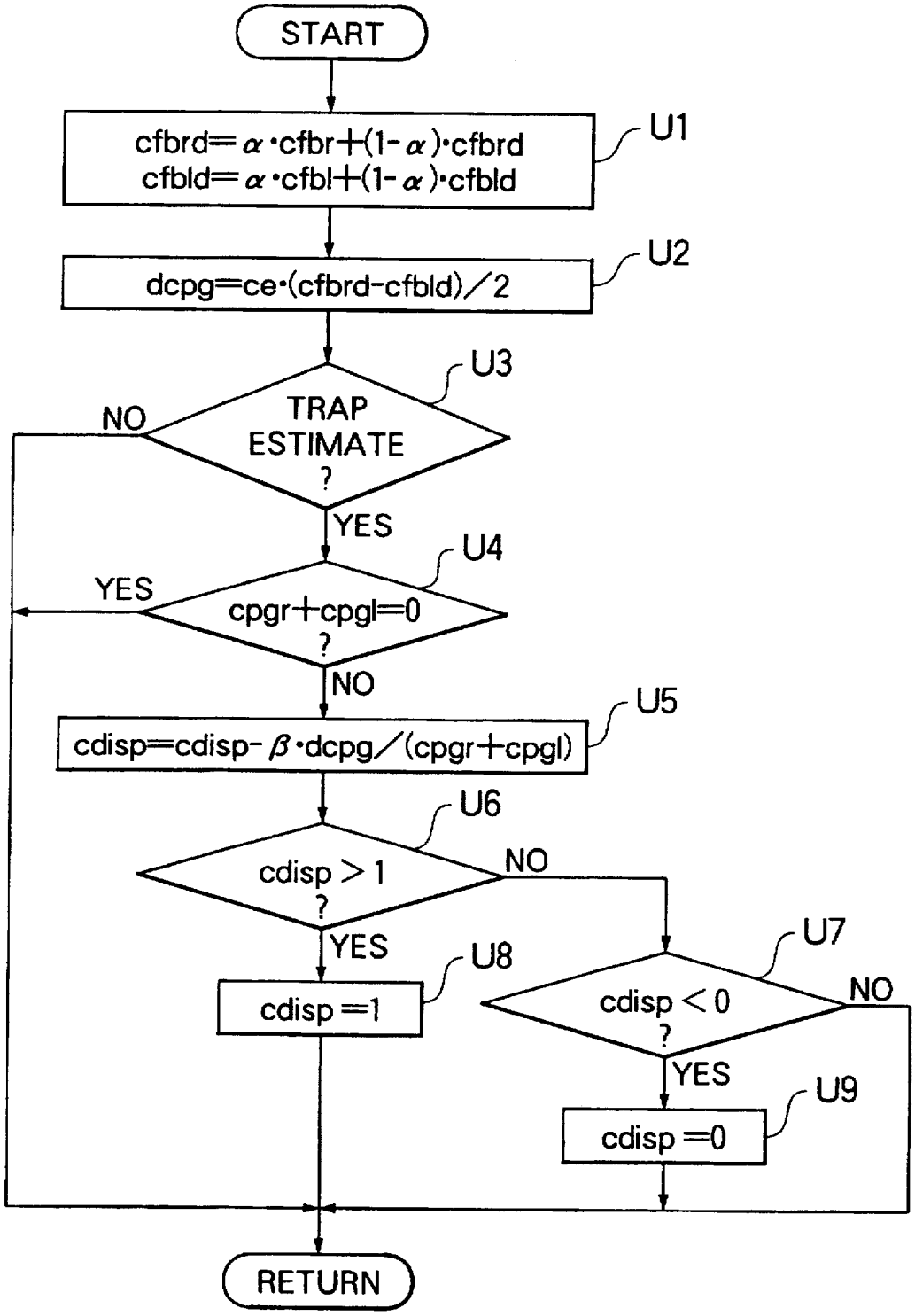
FIG. 8 is a flow chart of a subroutine for learning a distribution ratio of the purge gas to respective banks in the main routine of FIG. 3.

First, the learning control of the distribution ratio of the purge gas in step T8 to the respective banks BR, BL referring to the flow chart of FIG. 8.

Control unit CU calculates mean feedback compensation values cfbrd, cfbld of the right and left banks BR, BL in step U1.

$$cfbrd=\alpha*cfbr+(1-\alpha)*cfbrd \quad 1$$

$$cfbld=\alpha*cfbl+(1-\alpha)*cfbld \quad 1$$

wherein cfbrd: mean feedback compensation value of the right bank cfbld: means feedback compensation value of the left bank α: weight coefficient Next, in step U2, the control unit CU calculates the deviation dcpg of the purge gas ratio with regard to the right and left banks.

$$dcpg=ce*(cfbrd-cfbld)/2 \quad 3$$

Next, the control unit judges whether or not a condition for trap amount estimate is met (step U3). Then, the control unit CU judges whether or not a vapor fuel is introduced, in particular, whether or not a sum of the actual purge gas ratios cpgr, cpgl is zero in this embodiment (step U4). If the judgment is Yes, there is no introduction of the vapor and there is no need to execute the further steps. If the judgment is No, the control unit calculates the distribution ratio cdisp (step U5).

$$cdisp=cdisp-\beta*dcpg/(cpgr+cpgl) \quad 4$$

wherein dcpg:the deviation of the purge gas ratio cdisp: distribution ratio to the right and left banks BR, BL with regard to the purge gas ratio.

β: feedback gain of the distribution ratio. If the value cdisp is greater than one as a result of the calculation, the control unit CN provides the value cdisp with one. If the value cdisp takes a value smaller than zero, the control unit CN provides the value cdisp with zero (steps, U6, U7, U8 and U9). The control unit repeats the process from U5–U9 until the conditions for the estimate of the trap amount is met in step U4. Through the above process, an inappropriate value cdisp is renewed and thus the distribution ratio cdisp can be optimized.

Figure 9:
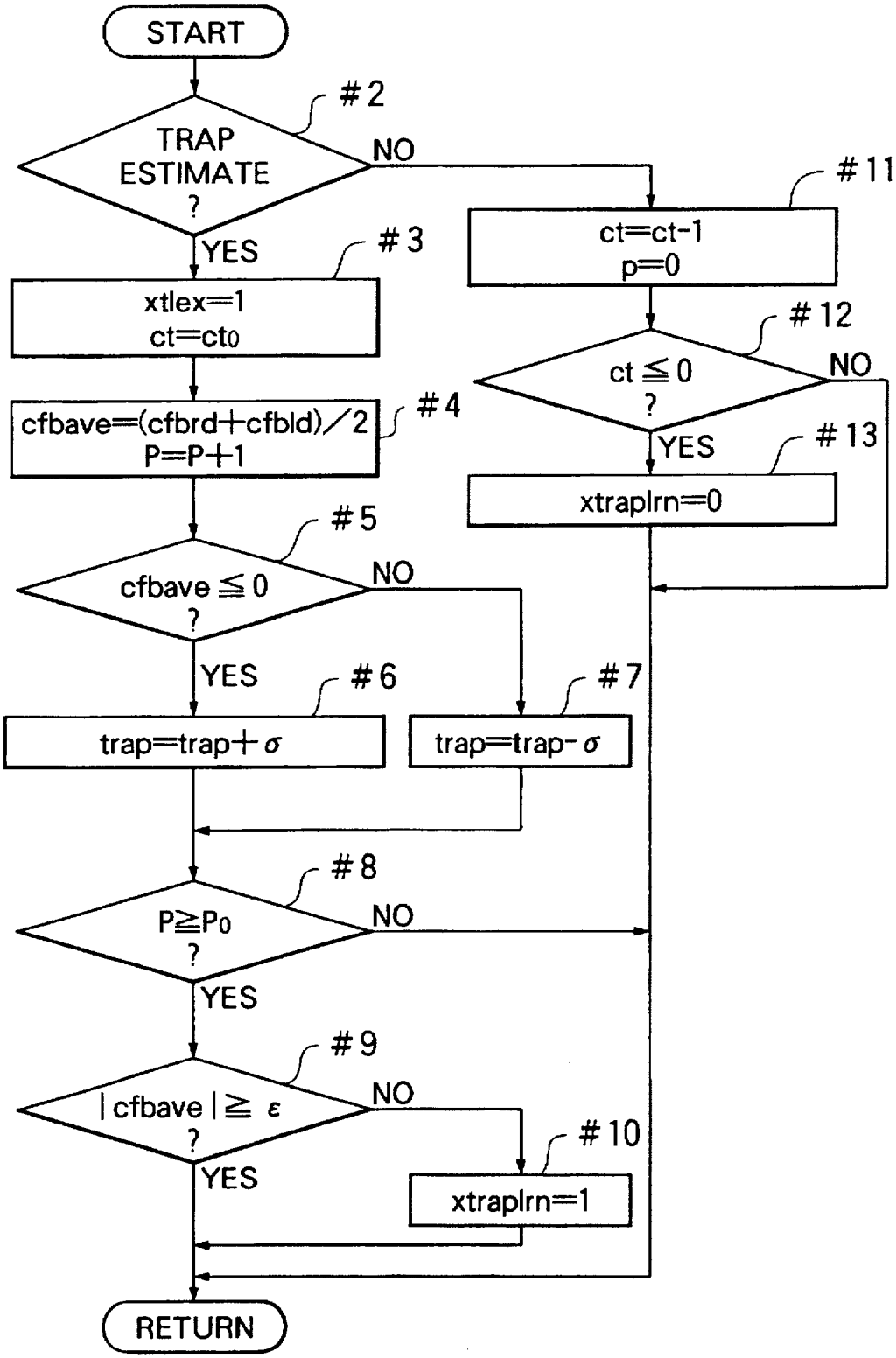
FIG. 9 is a flow chart of a subroutine for calculating the trap amount in the main routine of FIG. 3.

Next, the process of the estimate of the vapor fuel or purge gas trap amount is explained specifically in accordance with the flow chart shown in FIG. 9.

In step #2, it is judged whether or not predetermined conditions for the trap amount estimate are met. If the following conditions are met, the control unit holds that the conditions for the trap amount estimate are met.

(1) the canister purge is underway.

(2) the A/F feedback control is underway.

Figure 7:
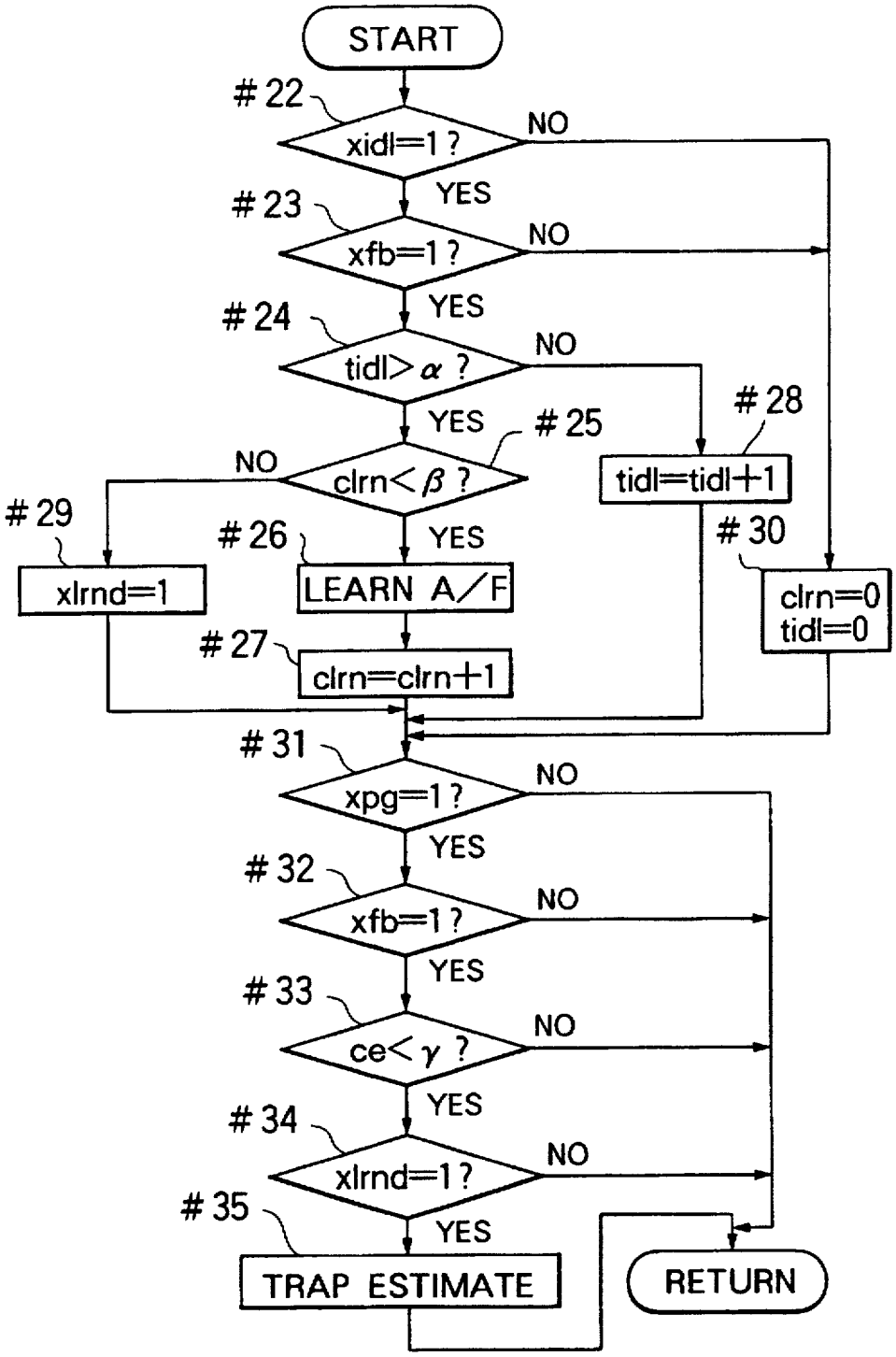
FIG. 7 is a flow chart of a subroutine for executing a speculation of a trap amount of the vapor fuel in the main routine of FIG. 3.

(3) the charging efficiency (ce) is smaller than a predetermined value (see step #33 in FIG. 7).

(4) the A/F learning control is completed (see #34 in FIG. 7).

As a further condition, whether or not the charging efficiency is between the upper limit of the above (3) and a lower limit or a second predetermined value may be added so that the process for the trap amount estimate can be suspended when the intake air pressure is lower than a predetermined value.

In other words, where the canister purge and A/F feedback control are suspended, the charging efficiency is greater than the predetermined value, or the A/F learning control is not completed, the estimate of the trap amount is prohibited. This reason is as follows.

Where the canister purge or A/F feedback control is suspended, it is impossible to estimate the trap amount because there is no relationship between the trap amount and the feedback control parameters, such as feedback compensation values.

Where the charging efficiency or intake air pressure is high, the pressure difference due to the purge control valve is very small and pulsation of the intake air is remarkable, and thus the feedback compensation value would be unduly fluctuated. As a result, it is impossible to calculate the purge air amount precisely.

Where the charging efficiency or the intake gas pressure is very low, the pressure difference due to the purge control valve is too large to calculate the purge air amount precisely.

Where the A/F learning control has been completed, the accuracy of the trap amount estimate is remarkably improved as aforementioned.

If it is judged that the conditions for the trap amount estimate are met in step #2, a trap amount estimate prohibition counter ct is set at a initial value ct0 in step #3. Next, the counter ct is provided for counting a time period in which the execution of the trap amount estimate is prohibited. In step #4, the mean feedback compensation value cfbave is calculated. Concurrently, a counter P for counting how many the value is calculated is incremented by 1. In this embodiment in the engine utilizing the linear O2 sensor 9a, 9b, the mean feedback compensation value cfbave is defined as an arithmetic mean of the feed back compensation value at certain intervals.

For example, if the estimated trap amount is between a value a1 and a3 in the case where the true value of the trap amount is the value a2, it is judged that the estimate process has been completed. In FIG. 10, the characteristic curve G1 shows the value |cfbave|. In case of trap >a2, cfbave is greater than zero. For trap<a2, the value cfbave is smaller than 0.

A judgement is made in step #5 as to whether or not the value cfbave is not greater than zero. If this judgment is Yes, the estimated trap amount is increased by the compensation value σ. On the contrary, where the value cfbave is greater than zero (judgment is No), the estimated value trap is decreased by the value σ (step #6, #7). Next, in step #8, it is judged whether or not the counter P is greater than P0. In case of P>P0, the process is returned to the step #2 without estimating the trap amount. In this subroutine, if the counter P is smaller than the value P0, the trap amount estimate is not made since it is considered the mean feedback compensation cfbave is not stable enough as a result of the fluctuation of the feedback compensation value cfb.

Next, in step #8, if it is judged as P≧P0 (judgment is Yes), a further judgement is made as to whether or not an absolute value of the mean feedback compensation value |cfbave| is greater than a predetermined limit ε in step #9. If the value |cfbave| is smaller than the value ε, the control unit holds that the estimated trap amount is substantially the same as the true trap amount and keeps the estimated value trap.

Where it is judged as |cfbave|<ε (judgment is No), the trap amount completion flag xtraplrn takes a value 1 (step #10).

Meanwhile, in the step #2, if it is held that the conditions for the trap estimate process are not met, the counter ct for the prohibition term of the trap amount estimate process is started to be counted by decrementing one by one. At the same time, the counter P is reset at zero.

Next, it is judged whether or not the counter ct is zero, that is, whether or not a predetermined time period ct0 has been passed after the trap amount estimate had been prohibited. In case of ct≦0 in step #12, the trap amount estimate completion flag xtraplrn is reset at zero in step #13. In this case, the estimated trap amount is deviated from the true value. In case of ct>0 in step #12, the step #13 is skipped.

Figure 11:
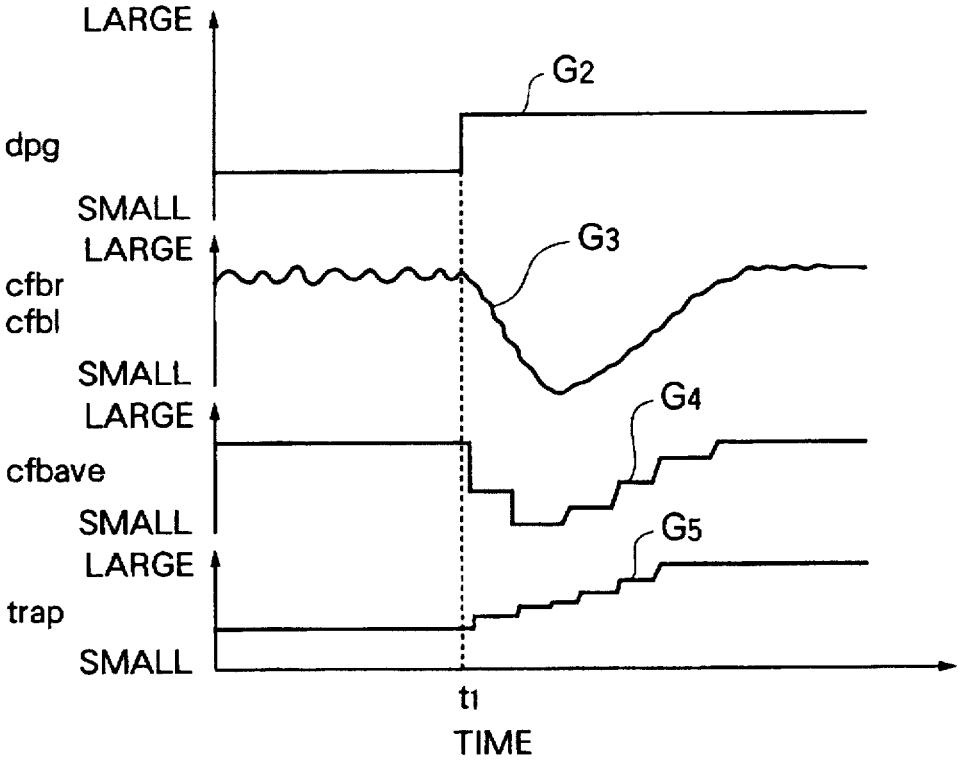
FIG. 11 is a graphical representation of characteristics for showing a change rate of drive duty ratio, an air fuel ratio feedback compensation value cfbr, cfbl, mean value of an air fuel feedback compensation value cfbave, and a trap amount.

Referring to FIG. 11, there are shown changes drive duty ratio dpg applied to the purge control valve 29 (characteristic G2), feedback compensation value cfb (characteristic G3), mean feedback compensation value (characteristic G4) and the estimated trap amount (characteristic G5).

As understood from FIG. 11, the estimated trap amount is provided from the time t1 and soon converged to substantially a constant value. Thus, the trap amount is properly estimated.

It is preferable that the estimate of the trap amount executed after completion of the A/F learning control where the control unit CN is provided with the A/F learning control system as aforementioned.

Hereinafter, a process for estimating the trap amount where the control unit CN is provided with the A/F learning control system is described. In this routine, where predetermined conditions for the A/F learning control are met in an idling operation, the control unit CN executes the A/F learning control and estimates the trap amount after the completion of the A/F learning control where the conditions for the execution of the trap amount estimate are met.

In particular, as shown in FIG. 7, in step #22, it is judged whether or not an idle judgment flag xidl is one. The flag xidl takes a value 1 where the engine speed is in the idling condition and takes a value zero in a non-idling condition. In this case, if the flag is judged as xidl=1 (judgment is Yes), steps #23–#29 for the A/F learning control during the idling condition is executed. If it is judged that the flag xidl is zero (judgement is No), a counter clrn of the execution of the A/F learning control and a counter tidl for counting the idling time are respectively reset at zero in step #30. Then, the step #31 is executed. It is judged whether or not the an A/F feedback control execution flag xfb is a value 1 and whether or not the counter tidl exceeds α in steps #23 and #24. In this case, the flag xfb takes a value 1 when the A/F feedback control is being done. If not(open loop control), it takes zero. The counter tidl is provided for counting the time period after the idling operation is started.

In this routine, the A/F learning control is not executed where the idling operation time is not greater than the predetermined time α. In this case, the operation of the engine CE is not stable enough. Where the flag xfb is zero in step #23, the steps #24–#29 are not executed. The counter clrn and counter tidl are reset at zero respectively. Thereafter, the step #31 is executed.

Where the judgment is made as xfb=1 in step #23 (Yes), and tidl ≦α, the learning control is not executed either. Thus, in step #28, the counter tidl is incremented by one and then the step #31 is executed.

On the other hand, where it is judged as tidl>α in step #24 (Yes), it is judged whether or not the counter clrn is smaller than a predetermined value β in step #25. The counter clrn is provided for counting a number of the A/F learning control executed after the idling operation is started. In this case, where the execution number of the A/F is not smaller than the value β, it is held that the A/F learning control has been completed.

In case of clrn<β in step #25, the A/F learning control is continued in step #26. In step #27, the counter clrn is incremented by one. Then, the step #31 is executed. The A/F is executed in a manner such that the feedback compensation value takes a neutral value or zero as a mean value where the A/F deviation is substantially zero by, for example, changing the fuel injection characteristics of the fuel injection valve 15.

In case of clrn≠β in step #25 (judgment is No), the flag xlrand is set at one since the A/F learning control is completed. Then, the step #31 is executed.

Thus, it is judged whether or not the conditions for the trap amount estimate are met in steps #31–#34.

In particular, it is judged whether or not a purge execution flag xpg is 1, namely whether or not the canister purge is underway, an A/F feedback control execution flag is 1, namely whether or not the A/F feedback control is underway, whether or not the charging efficiency ce is smaller than a predetermined value γ or whether or not the flag xlrnd is one, namely, whether or not the A/F learning control has been completed in steps #31–#34 in this order.

Where it is judged as xpg=1, xfb=1, ce<γ and xlrnd=1 (judgments of steps #31–#34 are all Yes), the conditions for the execution of the trap amount estimate are met. Thus, the trap amount is estimated in step #35. The specific process for estimate of the trap amount has been explained in connection with FIG. 2.

On the other hand, either one of the judgements in steps #31–#34, it is judged that the conditions for the execution of the trap amount is met. In this case, the step #35 is skipped.

Thus, the trap amount estimate is executed after the completion of the A/F learning control as shown in the flow chart of FIG. 7. According to the above method, the accuracy of the estimate of the trap amount can be improved.

Hereinafter, the calculation of the purge gas ratio (vapor fuel discharge amount) and the actual purge gas ratio (vapor fuel introduction amount) and The A/F control (fuel injection control) are described.

In step #41, the pressure difference dp through the purge valve 29 is calculated taking reference with a table 1 based on the intake air charging efficiency. In this case, the expression sipol (table 1, ce) means a value dp corresponding to a certain charging efficiency ce in the table 1 which shows a predetermined relationship between the value ce as an independent variable and the value dp as a dependent variable. The pressure difference dp can be calculated as aforementioned.

In this case, the value dp may be calculated directly by utilizing a function f1(ce) without referring to the table 1.

In step #42, the purge air amount is calculated based on the pressure difference dp and the drive duty ratio dpg applied to the purge control valve 29 referring to the purge air amount map 1. In this case, the expression smap (map 1, dpg, dp) means a value qpg corresponding to certain values dpg and dp in the map 1 which shows a predetermined relationship between the values dpg and dp as independent variables and the value qpg as a dependent variable.

Thus, the map 1 is one which show the relationship between the drive duty ratio dpg, pressure difference dp and purge air amount qpg. The purge air amount can be calculated based on the drive duty ratio and the pressure difference dp through the purge control valve as aforementioned.

Meanwhile, the purge air amount qpg may be calculated directly by utilizing a function f2(dpg, dp) showing a relationship between the values dpg, dp and qpg.

In step #43, the vapor fuel discharge amount gpg is calculated by utilizing a vapor fuel discharge amount map (map 2) based on the purge air amount qpg and the trap amount trap.

In this case, the expression smap (map 2, dpg, trap) means a value gpg corresponding to certain values qpg and trap in the map 2 which shows a predetermined relationship between the values qpg and trap as independent variables and the value gpg as a dependent variable. The purge map 2 is one which shows a relationship between the purge air amount qpg, trap amount trap and the fuel amount discharge amount gpg.

Figure 12:
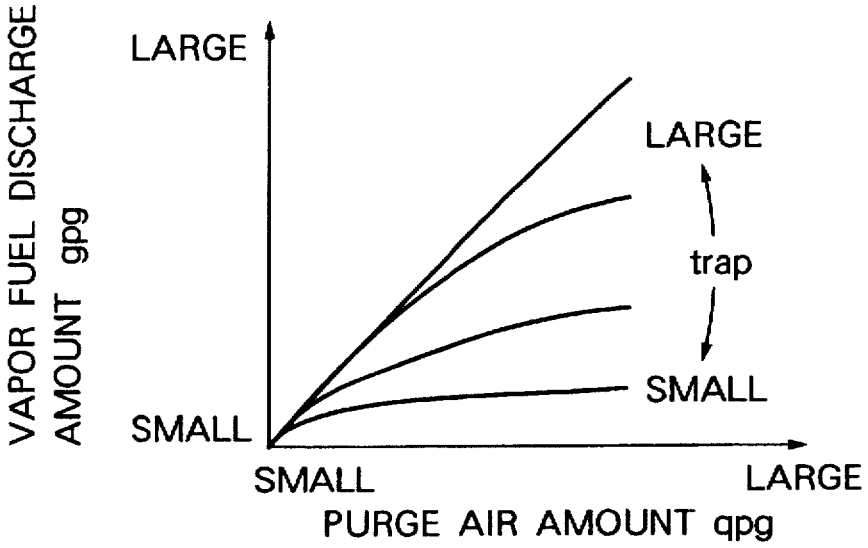
FIG. 12 is a graphical representation of characteristics of a relationship between an emission amount of the vapor fuel and an amount of a purge air.

In FIG. 12, there is shown an example of dependency of the vapor fuel discharge amount gpg against the purge air amount qpg and the trap amount trap. A vapor fuel discharge amount map 3 is a map which shows, for example, a relationship of FIG. 12.

Meanwhile, the vapor fuel discharge amount gpg may be calculated directly by utilizing a function f3(gpg, trap) which shows relationships between the values qpg, trap and gpg.

In step #44, the purge gas ratio cpgo is calculated by the following equation.

$$cpgo=Ys*120/(\gamma 0*Vc)*gpg/ne \quad 5$$

wherein cpgo:purge gas ratio

Ys: conversion factor for obtaining the intake air amount to the fuel injection amount $\gamma 0$: density Vc:cylinder effective volume gpg:vapor fuel discharge amount ne: engine speed (r.p.m)

Meanwhile the value $120/(\gamma 0*Vc)$ is an inverse number of an intake air amount introduced to the combustion chamber 4 per unit time period (second) or a mass flow rate. Thus, the value $Ys*120/(\gamma 0*Vc)$ is an inversion number of the required fuel injection amount. Thus, the purge gas ratio cpgo is a value of the vapor fuel discharge amount divided by the required fuel injection, in other words, a ratio of the vapor fuel discharge amount to the entire fuel mass flow rate.

In step #45, the purge gas ratios cpg0r, cpg0l are calculated based on the distribution ratios to the bank BR, BL.

$$cpg0r=cpgo*2*cdisp \quad 6$$

$$cpg0l=cpgo*2*(1-cdisp) \quad 7$$

wherein cpg0r: purge gas ratio of the right bank cpg0l:purge gas ratio of the left bank cdisp:distribution ratios to the right and left banks BR, BL.

Next, in step #46, the control unit CN calculates the actual purge gas ratios cpgr, cpgl are calculated based on the distribution ratios cdisp to the respective banks.

$$cpgr=\gamma*cpgr*(1-\gamma)*cpg0r \quad 8$$

$$cpgl=\gamma*cpgl*(1-\gamma)*cpg0l \quad 9$$

wherein cpgr: actual purge gas ratio of the right bank cpgl: actual purge gas ratio of the left bank $\gamma$: primary filter coefficient ($0<\gamma<1$).

The equations 8 and 9 are model equations showing characteristics of the time lag due to the vapor fuel path to the banks BR, BL. If the filter coefficient is properly provided in accordance with the configurations of the intake system of the engine CE and the purge passage 28, the actual purge gas ratios cpgr, cpgl can be obtained through the equations 8, 9.

Next, the control unit CU calculates the actual fuel injection amount to be actually injected from the injector 15 based on the following equations 10, 11 in step #27.

$$tar=K*(ce*ctotalr-cpgr) \quad 10$$

$$tal=K*(ce*ctotall-cpgl) \quad 11$$

wherein tar:fuel injection pulse width of a cylinder of the right bank tal:fuel injection pulse width of a cylinder of the left bank K:conversion coefficient ce:intake air charging efficiency ctotalr:compensation coefficient for the right bank ctotall:compensation coefficient for the left bank.

Thus, desirable fuel injection pulse widths tar, tal can be determined taking account of the introduction of the purge gas for the right and left banks respectively by subtracting the fuel injection amount based on the purge gas ratio from the normal fuel injection amount.

In step #48, the fuel is injected from the fuel injection valve 15 with the actual fuel injection pulse width tar, tal which is calculated in the step #47, and then the process is returned to step #41. Thus, according to the present invention, even when the canister purge is underway, the desirable fuel amount is supplied accurately in accordance with the operating condition so that the accuracy of the A/F control (fuel injection amount control) can be improved to thereby keep the actual A/F at the target value as close as possible. It should be noted that the A/F control in which the required fuel injection amount is determined in accordance with the engine operating condition is a feedback control but the process for eliminating the influence due to the canister purge by subtracting the vapor fuel introduction amount from the required fuel injection amount is a feedforward control. Thus, there is not time lag in the calculation of the actual purge gas ratio or the vapor fuel injection amount. And thus, there is no substantial deviation of the actual A/F from the target value.

As aforementioned, in the engine CE of the present embodiment, the vapor fuel trap amount in the canister is estimated, the vapor fuel introduction amount (actual purge gas ratio) is calculated precisely based on the estimated trap amount, and then the actual fuel injection amount is determined by subtracting the vapor fuel injection amount from the required fuel injection amount. Therefore, the vapor fuel introduced to the intake system 10 or the combustion chamber 4 due to the canister purge does not badly affect the A/F feedback control. As a result, once the estimate of the trap amount is completed, any substantial deviation of the A/F from the target value is not produced.

However, where the process for estimating the trap amount is not completed, in other words where the flag xtraplrn is zero, the actual purge gas ratio or the vapor fuel introduction amount is not necessarily obtained accurately. In view of this, it is preferable that the canister purge is prohibited or restricted if the trap amount estimate is not completed.

The prohibition of the canister purge may be executed during the idling of the engine.

It is preferable that when the purge valve 29 is opened to start the canister purge, the drive duty ratio for the purge control valve 29 (purge air amount) is gradually increased to the target value which is determined in accordance with the operating condition in order to prevent the fuel supply characteristic to the combustion chamber from being changed abruptly.

In this case, it is preferable that the increasing rate of the drive duty ratio at the beginning of the canister purge is reduced where the trap amount estimate is not completed.

Hereinafter, a process for controlling the increasing rate of the drive duty ratio carried out by a purge amount calculation subroutine shown in a form of flow chart of FIG. 6 in the step T6 of the main routine so as to increase the drive duty ratio gradually at the begining of the canister purge is described.

In this subroutine, in step #51, it is judged whether or not a purge execution flag xpg is one. If the flag xpg is zero (the judgment is No), a purge compensation value cmod is provided with zero in step #52.

The purge compensation value cmod takes a value between 0 and 1 for compensating the target drive duty ratio set in accordance with the engine operating condition CE at the begining of the canister purge. The product of the target drive duty ratio and the purge compensation value cmod is the drive duty ratio dpg actually applied to the purge control valve 29. The compensation value cmod takes zero before the start of the canister purge and increases gradually with an increment SP after the start of the canister purge and so the purge air amount does. If the value cmod reaches 1, it is kept at 1. Whenever the purge compensation value cmod is zero, the canister purger is suspended irrespective of the value of the target drive duty ratio. When the value cmod is 1, the target drive duty ratio is applied to the purge valve 29 as it is.

On the other hand, if the flag xpg is 1 (judgment is Yes), it is judged whether or not the compensation value cmod in step #53. If it is held that the value cmod is smaller than 1 (judgment is No), the value cmod is increased gradually on account of the judgment as to whether or not the trap amount estimate is completed. In particular, it is judged whether or not the flag xtraplrn is 1, namely whether or not the trap amount estimate is completed in step #54. If the flag xtraplrn is 1 (judgment is Yes), the increment SP is set at a relatively large value and then step #57 is executed. In this case, the trap amount estimate process has been completed so that the actual purge gas ratio of the vapor fuel introduction amount can be calculated accurately. Therefore, it is possible to start out the canister purge control abruptly without deteriorating the A/F control. In view of this, in the above situation, a larger increment SP is provided to accomplish the target drive duty ratio as soon as possible.

Figure 13:
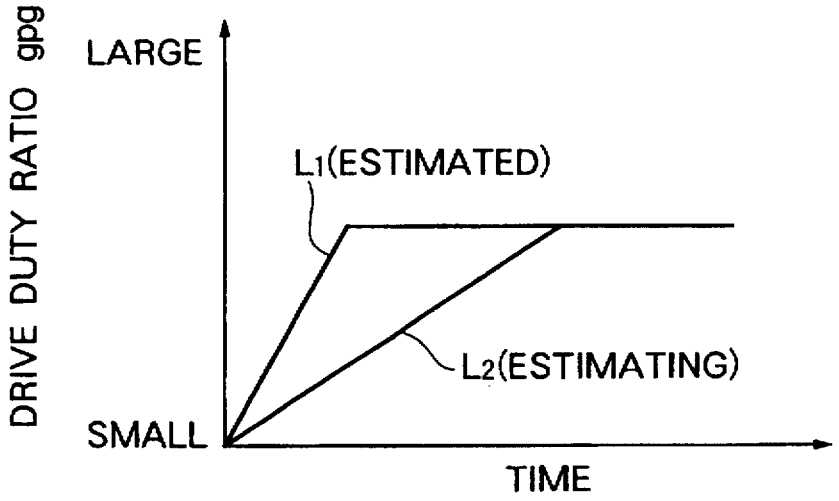
FIG. 13 is a graphical representation of a change rate of the drive duty ratio.

The drive duty ratio dpg applied to the purge control valve 29 changes, for example, as shown by line L1 in FIG. 13. In FIG. 13, a parallel portion with the time axis is a line of the target drive duty ratio.

On the other hand, where it is held that the flag xtraplrn is zero (judgment is No) in step #54, the increment SP is provided with a relatively small value KM2 (KM2<KM1) and the step #57 is executed. In this case, since the trap amount estimate is not completed, it is not able to calculate the actual purge gas ratio or vapor fuel introduction amount accurately. Thus, if the canister purge control is stated abruptly, the A/F control is deteriorated. In view of this, a smaller increment SP is provided to reduce the increasing rate of the purge compensation value cmod.

In this case, the drive duty ratio dpg applied to the actual purge control valve 29 changes, for example, as shown by line L2 in FIG. 13. In step #57, the present purge compensation value is calculated by adding the increment SP to the previous value cmod. If the value cmod exceeds 1, the value cmod is kept at 1. In this case, the expression addclip (cmod, SP, 1) means a treatment in which the increment SP is added to the compensation value SP and sets the upper limit at 1. In this manner, the purge compensation value is gradually increased.

Next, the drive duty ratio dpg to be actually applied to the purge valve 29 is calculated by means of the following equation 12.

$$dpg = cmod * smap\ (\text{map } 3,\ ne,\ ce) \qquad 12$$

wherein dpg: drive duty ratio cmod:purge compensation value smap (map 3, ne, ce): target drive duty ratio ne:engine speed ce:intake gas charging efficiency.

The expression smap (map 3, ne, ce) means a certain value of the drive duty ratio dpg corresponding to engine speed ne and charging efficiency in a duty ratio map 3 showing predetermined relationships between the engine speed ne and the charging efficiency as independent variables and the drive duty ratio dpg as a dependent variable. The duty ratio map 3 is a map showing relationships between the engine speed ne, charging efficiency ce and the drive duty ratio dpg.

As aforementioned, when the canister purge is started, the drive duty ratio dpg or the purge air amount is gradually increased.

In step #53, if it is held that the value cmod is 1 (judgment is Yes), the drive duty ratio dpg is calculated in the step #58 wherein the value cmod is 1.

Hereinafter, the purge execution judgment subroutine of the step T5 in the main routine is described in accordance with a flow chart shown in FIG. 5.

In step #61, it is judged whether or not the purge can be executed. If the judgment is No, a purge execution flag xpg is set at zero and then the process is returned to step #61. In this embodiment, where a cooling water temperature is not smaller than 80 degree centigrade and where the engine operating condition is in the A/F feedback zone or in an enrich zone, the purge of the vapor fuel can be executed.

If it is held that the purge can be executed (judgment of step #61 is Yes), a further judgment as to whether or not an idle judgment flag xidl is 1 or whether or not the operating condition is in an idling operation. If the flag xidl is zero (the judgment is No), or if the operating condition is not in the idling operation, the purge execution flag xpg is set at 1 in step #65.

In step #62, if judgment is xidl=1, judgments as to whether or not the A/F learning control valve completion flag xlrnd is 1 in step #63 and whether or not the trap amount estimate completion flag xtraplrn is 1 in step #64 are made.

In this embodiment, in case of xlrnd=1 and xtraplrn=1, or in the case where the A/F learning control and the trap amount is completed, the execution of the purge is allowed (the flag xpg set at 1).

Thus, if it is held as xlrnd=1 and xtrapirn=1 in the step #63 and #64, the flag xpg is set at 1. On the other hand, either the flag xlrnd or the flag xtraplrn is zero, the flag xpg is set at zero. According to the above procedure, the canister purge can be executed without producing any substantial deterioration in the A/F control or without substantial deviation from the target.

In the above embodiment, although the trap amount is estimated based on the mean feedback compensation value, the vapor fuel discharge amount (purge gas ratio) or the vapor fuel introduction amount (actual purge gas ratio) may be calculated based on the trap amount detected by a trap amount detecting sensor which is provided for detecting directly the trap amount. As the trap amount detecting sensor, it is possible to employ one for detecting the trap amount based on a capacity of an adsorbent in the canister 25, HC sensor or the like.

Hereinafter, changes of various variables in the vapor fuel control according to the present invention are explained taking reference with FIG. 14.

Figure 14:
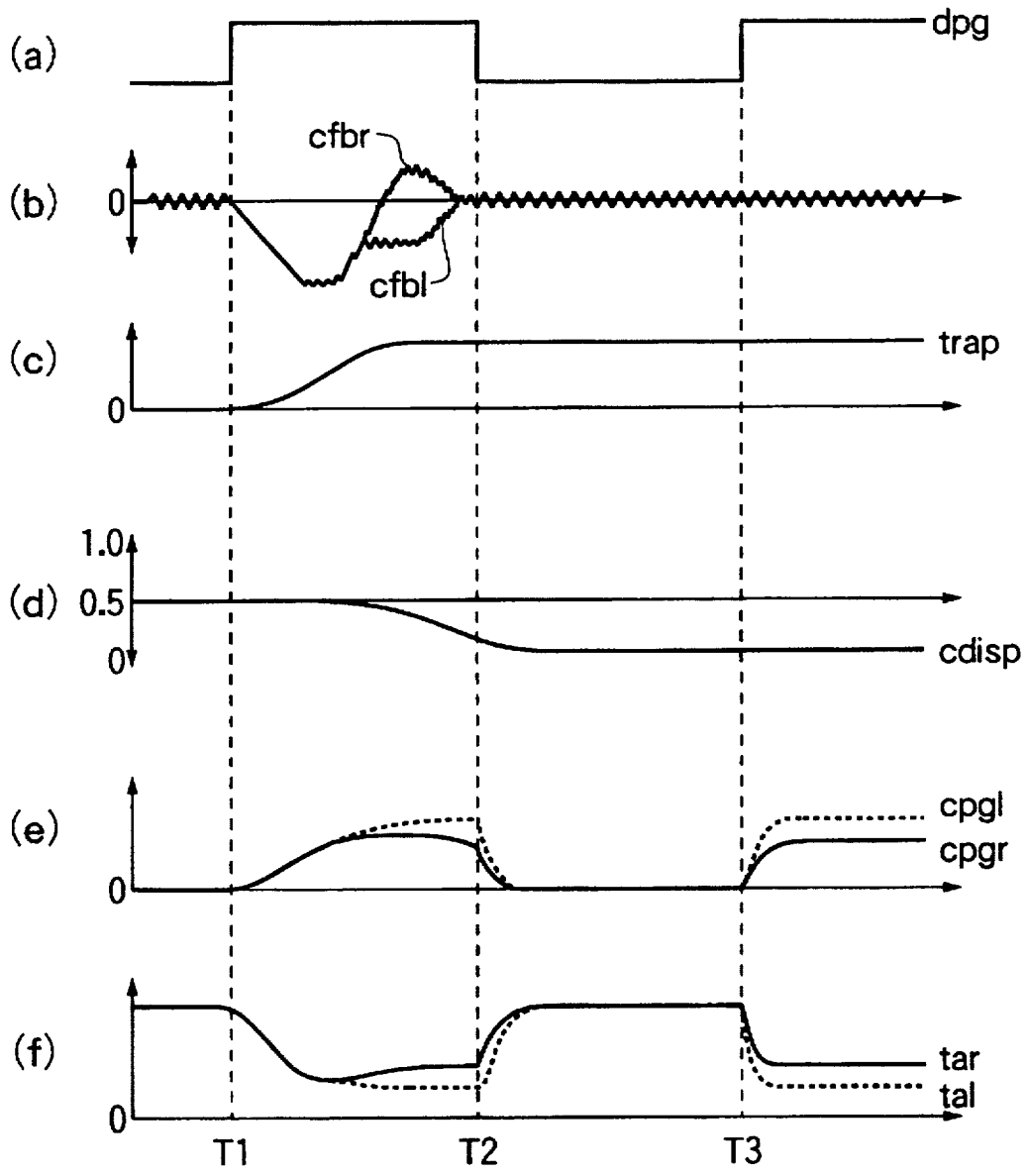
FIG. 14 is a graphical representation of a change rate of a drive duty ratio, an air fuel ratio feedback compensation values cfbr, cfbl, trap amount trap, distribution rate cdisp, purge gas rate cpgr, cpgl and fuel injection pulse width of an engine fuel injection valve.

FIG. 14(*a*) shows the change of the drive duty ratio.

In the illustrated embodiment, the duty ratio takes a value between 0 and 100%. The duty ratio is able to be provided in accordance with the operating condition as aforementioned and the opening of the purge valve can be freely controlled.

FIG. 14(*b*) shows the change of the A/F feedback compensation values cfbr, cfbl of the right and left banks.

FIG. 14(*c*) shows the change of the estimated trap amount.

FIG. 14 (*d*) shows the change of the distribution ratio of the purge gas ratio of the right and left banks.

FIG. 14(*e*) shows the change of the purge gas ratio.

FIG. 14 (*f*) shows the change of the fuel injection pulse width of a cylinder of the right and left banks.

According to the present invention, the A/F feedback control is executed as a premise of the purge control of the vapor fuel. In this case, the feedback compensation values cfbr, cfbl are provided for each cylinders of the respective banks BR, BL. And, the feedback control is stable so that the feedback compensation values cfbr, cfbl are substantially the same values (see FIG. 14(*b*)). Then, the conditions for the vapor fuel purge control are met and the purge control valve 29 is opened to start the purge control. The drive duty ratio is provided a value between 0 and 100%. Thus, the vapor fuel is purged into the combustion chamber 4 in addition to the normal liquid fuel from the injection valve to be combusted.

As a result, the intake gas mixture are made rich. This fact is detected by the O2 sensors 9*a*, 9*b* by sensing the oxygen amount in the exhaust gas from the right and left banks respectively. The control unit CN controls to reduce the compensation values cfbr, cfbl to make the intake gas mixture lean (see FIG. (*b*)). Concurrently, the control unit CN starts to calculate the purge gas ratio and correct the pulse width by converting the purge amount to the fuel injection pulse width equivalent to the normal liquid fuel amount from the injection valve (see FIGS. (*e*) and (*f*)).

In this case, the A/F feedback control is executed for each of the banks BR, BL by providing the compensation values cfbr, cfbl respectively. In the illustrated embodiment, the A/F of the right bank BR is quickly recovered compared with the left bank BL (see characteristics of lines cfbr, cfbl).

This means that an influence of the vapor fuel purge control in the right bank BR is less than that in the left bank BL. In other words, as a result that more purged component is introduced in the left bank than the right bank, the feedback compensation value cfbl for the left bank is kept small for longer period to thereby facilitate making the A/F lean.

The learning control for the distribution ratio cdisp and the trap amount trap are executed in the course of the above control so that the fuel injection pulse width is gradually reduced and that the fluctuation of the A/F feedback compensation values cfbr, cfbl are reduced as well and recovers the stability before the time T2. That is, the values cfbr and cfbl take substantially the same values.

This is because the purge gas ratio is determined correctly for the right and left banks BR, BL. Next, at the time T2, the drive duty ratio takes zero and the purge valve 29 is closed. Then, the purge gas ratios cpgr,cpgl become zero and the fuel injection pulse widths tar, tal are returned to the normal injection pulse widths (see FIG. 14(*b*) and FIG. 14(*c*)). In this case, the distribution ratio cdisp and the estimated trap amount trap obtained through the learning control between the time T1 and T2 are stored.

At a time T3, the drive duty ratio dpg is changed from 0 to 100 to make the purge valve open. And, the vapor fuel injection is started to be introduced to the combustion chamber so that the purge gas ratios cpgr, cpgl are provided for the right and left banks BR, BL based on the stored values of the distribution ratio cdisp and estimated trap amount trap. As a result, the fuel injection pulse widths tar, tal for the right and left banks BR, BL are reduced respectively by the equivalent pulse width of the vapor fuel to the liquid fuel . In this case, the equivalent pulse widths of the vapor fuel obtained through the stored values of the distribution ratio and the estimated trap amount is subtracted from the required fuel injection pulse widths tar, tal without executing a further learning control with regard to the values thereof. Thus, any substantial fluctuation of the A/F feedback compensation values cfbr, cfbl will not be produced.

According to the present invention, the leaning control is executed with regard to not only the trap amount of the vapor fuel to the canister but also the distribution ratio of the purge fuel to each of the cylinders or each groups of the cylinders. As a result, the purged fuel amount can be obtained accurately to prevent a bad influence on the A/F feedback control. Namely, according to the present invention, an appropriate fuel injection control can be executed irrespective of the execution of the vapor fuel purge control.

Although the present invention has been explained with reference to a specific, preferred embodiment, one of ordinary skill in the art will recognize that modifications and improvements can be made while remaining within the scope and spirit of the present invention. The scope of the present invention is determined solely by the appended claims.

What is claimed is:

1. A control system for a multiple cylinder engine comprising:

a vapor fuel introduction system for introducing a vapor fuel vaporized in a fuel tank into a common intake passage;

air fuel ratio detecting means for detecting an air fuel ratio in an intake passage for each cylinder or each group of cylinders of the engine downstream of the common intake passage;

feedback means for executing a feedback control with regard to a fuel supply amount based on an air fuel ratio feedback compensation value which is determined based on a difference between an output of the detection means and a target air fuel ratio for each cylinder or each group of cylinders of the engine so that the air fuel ratio of each cylinder or each group of cylinders is controlled to the target air fuel ratio; and fuel supply means for supplying an engine fuel for each cylinder so as to equalize the air fuel ratio feedback compensation values of each of the cylinders or each group of the cylinders during an introduction of the vapor fuel.

2. A control system as recited in claim 1 wherein the fuel supply means is provided with distribution ratio calculation means for calculating a distribution ratio of the vapor fuel introduced into each cylinder or group of cylinders respectively, the fuel supply means supplying the engine fuel to each cylinder or group of cylinders taking account of the distribution ratio of the vapor fuel.

3. A control system as recited in claim 2 and further comprising vapor fuel learning means for executing a learning control with regard to an amount of vapor fuel introduced to the engine based on the change of the feedback compensation value so that the distribution ratio is calculated based on the amount of vapor fuel obtained through the learning control.

4. A control system as recited in claim 3 wherein the engine is a V-type multiple cylinder engine with banks, wherein oxygen sensors for the banks of the engine are provided and wherein the distribution ratios of the vapor fuel for each of the banks are determined so that the feedback compensation values of each of the banks are equalized.

5. A control system as recited in claim 2 wherein the engine is a V-type multiple cylinder engine with banks, wherein oxygen sensors for the banks of the engine are provided and wherein the distribution ratios of the vapor fuel for each of the banks are determined so that the feedback compensation values of each of the banks are equalized.

6. A control system as recited in claim 2 wherein the fuel supply means reduces an amount of the fuel supply by a greater value for a cylinder or cylinders to which a greater amount of the vapor fuel is introduced so as to equalize the air fuel ratio feedback compensation values of each cylinder or each group of cylinders based on a distribution ratio of the vapor fuel during an introduction of the vapor fuel.

7. A control system as recited in claim 2 wherein the fuel supply means calculates an actual vapor fuel introduced to a cylinder and reduces an amount of the fuel supply for each cylinder or each group of cylinders so as to equalize the air fuel ratio feedback compensation values of each cylinder or each group of cylinders based on a distribution ratio of the vapor fuel during an introduction of the vapor fuel.

8. A control system as recited in claim 1 wherein the fuel supply means supplies the engine fuel so as to equalize the feedback compensation values for each cylinder or group of cylinders when a difference of the feedback compensation values exceeds a predetermined value between cylinders or groups of cylinders.

9. A control system as recited in claim 8 and further comprising vapor fuel learning means for executing a learning control with regard to an amount of vapor fuel introduced to the engine based on the change of the feedback compensation value, wherein the fuel supply means supplies the engine fuel to the engine so as to equalize feedback compensation values of each cylinder or group of cylinders.

10. A control system as recited in claim 9 wherein the engine is a V-type multiple cylinder engine with a pair of banks, and wherein the fuel supply means supplies the engine fuel so as to equalize the feedback compensation values of the cylinders of both banks when a difference of the feedback compensation values thereof exceeds a predetermined value.

11. A control system as recited in claim 8 wherein the engine is a V-type multiple cylinder engine with a pair of banks, and wherein the fuel supply means supplies the engine fuel so as to equalize the feedback compensation values of the cylinders of both banks when a difference of the feedback compensation values thereof exceeds a predetermined value.

12. A control system for a multiple cylinder engine comprising:

a vapor fuel introduction system for introducing a vapor fuel vaporized in a fuel tank into a common intake passage;

air fuel ratio detecting means for detecting an air fuel ratio in an intake passage for each of the cylinders or each group of cylinders of the engine downstream of the common intake passage;

fuel injecting means for injecting a fuel for a cylinder of the engine;

calculating means for calculating a basic fuel supply amount in accordance with an engine operating condition;

air fuel ratio feedback control means for compensating the basic fuel supply amount based on an air fuel compensation value obtained from a difference between an output of the detecting means and a target air fuel ratio for each cylinder or each group of cylinders to obtain a required fuel injection amount and to inject the required fuel injection so as to control an actual air fuel ratio of each of the cylinders or each group of the cylinders to the target air fuel value and injecting the required amount of the fuel;

distribution condition calculation means for calculating a distributing condition of the vapor fuel introduced into the cylinder or group of the cylinders based on the difference between the output of the detecting means and the target air fuel ratio; and vapor fuel compensation means for reducing the fuel supply amount based on the distributing condition of the vapor fuel for a cylinder to which more vapor fuel is introduced.

13. A control system as recited in claim 12 wherein the vapor fuel compensation means reduces the fuel supply amount based on the distributing condition so as to equalize the air fuel ratio feedback compensation value of the cylinder or the group of the cylinders to which more vapor fuel is introduced during the introduction of the vapor fuel.

14. A control system as recited in claim 12 wherein the vapor fuel compensation means calculates the actual vapor fuel amount introduced to the cylinder or group of the cylinders based on the distributing condition and reduces the fuel supply amount so as to equalize the air fuel ratio feedback compensation value of the cylinder or the group of the cylinders to which more vapor fuel is introduced during the introduction of the vapor fuel.

15. A control system as recited in claim 12 wherein the distribution condition calculation means calculates the distributing condition of the vapor fuel introduced to the cylinder or group of the cylinders based on the air fuel feedback compensation value for the cylinder or group of the cylinders.

16. A control system as recited in claim 12 wherein the distribution condition calculating means calculates the distributing condition of the vapor fuel introduced to the cylinder or group of the cylinders based on a variation of the air fuel feedback compensation value for the cylinder or group of the cylinders.

17. A control system as recited in claim 12 wherein the distribution condition calculation means comprises vapor fuel learning means for executing a learning control with regard to an amount of vapor fuel introduced to the cylinder or group of the cylinders based on the air fuel ratio feedback compensation value, so that the distribution condition calculation means calculates the distributing condition of the vapor fuel.

18. A control system for a multiple cylinder engine comprising:

a vapor fuel introduction system for introducing a vapor fuel vaporized in a fuel tank into a common intake passage;

air fuel ratio detecting means for detecting an air fuel ratio in an intake passage downstream of the common intake passage for each of the cylinders or each group of cylinders of the engine;

fuel injecting means for injecting a fuel for a cylinder of the engine;

calculating means for calculating a basic fuel supply amount in accordance with an engine operating condition;

air fuel ratio feedback control means for compensating the basic fuel supply amount based on an air fuel compensation value obtained from a difference between an output of the detecting means and a target air fuel ratio for each cylinder or each group of cylinders to obtain a required fuel injection amount and to inject the required fuel injection so as to control an actual air fuel ratio of each of the cylinders or each group of the cylinders to the target air fuel value;

distribution condition calculation means for calculating a distributing condition of the vapor fuel introduced into the cylinder or group of the cylinders based on the difference between the output of the detecting means and the target air fuel ratio; and vapor fuel compensation means for reducing the fuel supply amount based on the distributing condition so as to equalize the air fuel ratio feedback compensation value of the cylinder or the group of the cylinders during the introduction of the vapor fuel.

19. A control system as recited in claim 18 wherein the vapor fuel compensation means calculates the actual vapor fuel amount introduced to the cylinder or group of the cylinders based on the distributing condition and reduces the fuel supply amount so as to equalize the air fuel ratio feedback compensation value of the cylinder or the group of the cylinders to which more vapor fuel is introduced during the introduction of the vapor fuel.

20. A control system as recited in claim 18 wherein the distribution condition calculation means calculates the distributing condition of the vapor fuel introduced to the cylinder or group of the cylinders based on the air fuel feedback compensation value for the cylinder or group of the cylinders.

21. A control system as recited in claim 18 wherein the distribution condition calculating means calculates the distributing condition of the vapor fuel introduced to the cylinder or group of the cylinders based on a variation of the air fuel feedback compensation value for the cylinder or group of the cylinders.

22. A control system as recited in claim 18 wherein the distribution condition calculation means comprises vapor fuel learning means for executing a learning control with regard to an amount of vapor fuel introduced to the cylinder or group of the cylinders based on the air fuel ratio feedback compensation value, so that the distribution condition calculation means calculates the distributing condition of the vapor fuel.

23. A control system for a multiple cylinder engine comprising:

a vapor fuel introduction system for introducing a vapor fuel vaporized in a fuel tank into a common intake passage;

air fuel ratio detecting means for detecting an air fuel ratio in an intake passage for each of cylinders or each group of cylinders of the engine downstream of the common intake passage;

fuel injecting means for injecting a fuel for each of the cylinders of the engine;

air fuel ratio feedback control means for compensating a fuel supply amount in accordance with an engine operating condition for the cylinder or group of the cylinders based on an air fuel compensation value obtained from a difference between an output of the detecting means and a target air fuel ratio to inject the required fuel injection for each cylinder or each group of cylinders so as to control an actual air fuel ratio of each of the cylinders or each group of the cylinders to the target air fuel value and injecting the required amount of the fuel;

distribution condition calculation means for calculating a distributing condition of the vapor fuel introduced into the cylinder or group of the cylinders based on the difference between the output of the detecting means and the target air fuel ratio; and vapor fuel compensation means for reducing the fuel supply amount based on the distributing condition of the vapor fuel for a cylinder to which more vapor fuel is introduced.

24. A control system as recited in claim 23 wherein the vapor fuel compensation means calculates the actual vapor fuel amount introduced to the cylinder or group of the cylinders based on the distributing condition and reduces the fuel supply amount so as to equalize the air fuel ratio feedback compensation value of the cylinder or the group of the cylinders to which more vapor fuel is introduced during the introduction of the vapor fuel.

25. A control system as recited in claim 23 wherein the distribution condition calculation means calculates the distributing condition of the vapor fuel introduced to the cylinder or group of the cylinders based on the air fuel feedback compensation value for the cylinder or group of the cylinders.

26. A control system as recited in claim 23 wherein the distribution condition calculating means calculates the distributing condition of the vapor fuel introduced to the cylinder or group of the cylinders based on a variation of the air fuel feedback compensation value for the cylinder or group of the cylinders.

27. A control system as recited in claim 23 wherein the distribution condition calculation means comprises vapor fuel learning means for executing a learning control with regard to an amount of vapor fuel introduced to the cylinder or group of the cylinders based on the air fuel ratio feedback compensation value, so that the distribution condition calculation means calculates the distributing condition of the vapor fuel.

28. A control system for a multiple cylinder engine comprising:

a vapor fuel introduction system for introducing a vapor fuel vaporized in a fuel tank into a common intake passage;

air fuel ratio detecting means for detecting an air fuel ratio in an intake passage for each of cylinders or each group of cylinders of the engine downstream of the common intake passage;

fuel injecting means for injecting a fuel for each of the cylinders of the engine;

air fuel ratio feedback control means for compensating a fuel supply amount in accordance with an engine operating condition for the cylinder or group of the cylinders based on an air fuel compensation value obtained from a difference between an output of the detecting means and a target air fuel ratio to inject the required fuel injection for each cylinder or each group of cylinders so as to control an actual air fuel ratio of each of the cylinders or each group of the cylinders to the target air fuel ratio and injecting the required amount of the fuel;

distribution condition calculation means for calculating a distributing condition of the vapor fuel introduced into the cylinder or group of the cylinders based on the difference between the output of the detecting means and the target air fuel ratio; and vapor fuel compensation means for compensating the fuel supply amount actually supplied by the fuel injection means to equalize the air fuel feedback compensation value for the cylinder or group of the cylinders based on the distributing condition of the vapor fuel during the introduction of the vapor fuel.

29. A control system as recited in claim 28 wherein the vapor fuel compensation means calculates the actual vapor fuel amount introduced to the cylinder or group of the cylinders based on the distributing condition and reduces the fuel supply amount so as to equalize the air fuel ratio feedback compensation value of the cylinder or the group of the cylinders to which more vapor fuel is introduced during the introduction of the vapor fuel.

30. A control system as recited in claim 28 wherein the distribution condition calculation means calculates the distributing condition of the vapor fuel introduced to the cylinder or group of the cylinders based on the air fuel feedback compensation value for the cylinder or group of the cylinders.

31. A control system as recited in claim 28 wherein the distribution condition calculating means calculates the distributing condition of the vapor fuel introduced to the cylinder or group of the cylinders based on a variation of the air fuel feedback compensation value for the cylinder or group of the cylinders.

32. A control system as recited in claim 28 wherein the distribution condition calculation means comprises vapor fuel learning means for executing a learning control with regard to an amount of vapor fuel introduced to the cylinder or group of the cylinders based on the air fuel ratio feedback compensation value, so that the distribution condition calculation means calculates the distributing condition of the vapor fuel.

* * * * *